US005769106A

United States Patent [19]

Achuff

[11] Patent Number: 5,769,106

[45] Date of Patent: Jun. 23, 1998

[54] CONVERTIBLE PANEL AND SHELTER SYSTEM

[76] Inventor: Jonathan M. Achuff, 2550 S. Garfield St., Denver, Colo. 80210

[21] Appl. No.: 648,325

[22] Filed: May 15, 1996

[51] Int. Cl.[6] ..... E04H 15/30

[52] U.S. Cl. ..... 135/95; 135/97; 47/95; 5/417

[58] Field of Search ..... 135/95, 96, 97; 47/95, 56; 5/413 R, 414, 417; 2/69, 69.5

[56] References Cited

U.S. PATENT DOCUMENTS

| | | | |
|---|---|---|---|
| 36,685 | 10/1862 | Brecht et al. | 135/95 |
| 1,193,443 | 8/1916 | Swan | 2/89 |
| 1,215,139 | 2/1917 | Gail, Jr. | 135/95 |
| 1,260,612 | 3/1918 | Whall | 135/1 |
| 1,494,050 | 5/1924 | Wittmann | 135/1 |
| 1,895,911 | 1/1933 | Bosson, Jr. | 2/89 |
| 2,093,889 | 9/1937 | Horn | 2/89 |
| 2,315,126 | 3/1943 | Parnow | 5/417 |
| 2,720,654 | 10/1955 | Stephenson | 5/417 X |
| 2,745,105 | 5/1956 | Schaefer | 2/89 |
| 3,381,306 | 5/1968 | Innes | 5/417 X |
| 3,699,986 | 10/1972 | Kirkham | 135/1 |
| 4,063,566 | 12/1977 | Millerioux | 135/1 |
| 4,239,135 | 12/1980 | Armstrong | 224/154 |
| 4,331,272 | 5/1982 | Ward | 224/154 |
| 4,471,794 | 9/1984 | Kirkham, Jr. | 135/95 |
| 4,507,805 | 4/1985 | Calutoiu | 2/69.5 |
| 4,513,461 | 4/1985 | Tardivel | 2/69.5 |
| 4,594,735 | 6/1986 | Rolf et al. | 2/89 |
| 4,631,765 | 12/1986 | Casey | 5/417 |
| 4,862,906 | 9/1989 | Jordan | 135/95 |
| 5,217,034 | 6/1993 | Yih et al. | 135/90 |
| 5,277,349 | 1/1994 | Rowe | 224/154 |

FOREIGN PATENT DOCUMENTS

| | | | |
|---|---|---|---|
| 0026151 | 4/1981 | European Pat. Off. | 2/69.5 |
| 0347313 | 8/1960 | Switzerland | 135/96 |

OTHER PUBLICATIONS

Eureka 1975 Quality Camping Tents.

Boy Scouts of America National Council, *Handbook for Boys*, Fifth Edition, 1948, pp. 340–343, Description of construction and use of "Trail Tent".

*Primary Examiner*—Lanna Mai

[57] ABSTRACT

A system of panel units is provided for creating diverse items for use in both planned and emergency situations in outdoor settings. A prime panel unit can be used to form a tent, bivouac sack, tarp, fly, sail, signal panel, ground cloth, weatherproof suit, backpack, or kayak hull covering. Quarter panel units can be used to form items such as bags, pack covers, ground cloths, and rain capes. Various combinations of units can be fastened together to create a wide variety of larger and more diverse tents, tent modules, flies, and other items to meet diverse needs.

9 Claims, 21 Drawing Sheets

CONVERTIBLE PANEL AND SHELTER SYSTEM

BACKGROUND OF THE INVENTION

1. Field of the Invention

This invention relates to the general field of outdoor equipment and, more specifically, to multipurpose equipment used as shelters, apparel, backpacks, watercraft, and other items for use in both planned and emergency situations in outdoor settings.

2. Prior Art

A variety of light-weight portable shelters, including tents and bivouac sacks, have been used for mountaineering, backpacking, canoeing, kayaking, rafting, bicycling, hunting, fishing, and other outdoor activities that commonly involve camping or bivouacking in remote areas. The requirements for shelters on different outings vary widely, depending on the weather, terrain, size of the party, and purpose anticipated for each outing. Consequently, tents have been provided in many different styles and sizes. In many circumstances, particularly in emergencies, the shelter requirements change during the outing or are unknown when selecting equipment, making an appropriate selection difficult. It can also be prohibitively expensive for either an individual or group to acquire a set of tents to adequately meet the diversity of requirements for various outings.

In the past, tents have been used that are designed to be set up in a single pre-determined form having fixed dimensions. Within these limitations, larger, multi-person tents generally have several advantages over smaller tents. The volume-to-surface-area ratio is generally greater in the larger tent, resulting in less tent weight and bulk for each person to carry, less interior surface condensation due to the greater interior air volume, and a less cramped and claustrophobic environment. Larger tents also generally have higher ceilings, which facilitate engaging in activities that are preferably performed in a sitting or standing position. A multi-person tent is often required for planning, work, or social activities, particularly during extended periods of inclement weather. In treating illnesses and injuries, the larger amount of space may be critical.

Disadvantages of a larger tent include the fact that it requires a large, contiguous, relatively flat area on which to be erected, so it cannot be used in confined areas or in rough terrain. Tents with high amounts of surface area and high profiles are more prone to be adversely affected or destroyed by high winds or heavy snowfall. In the event that a tent is seriously damaged, destroyed, or lost, the entire party relying on that tent is then left without shelter. If a party using a single tent becomes separated accidentally or wishes to separate for any reason, some part of the party is left without shelter. If equipment or supplies are distributed among party members to prevent overloading a person carrying a relatively heavy tent, both that member and other members may be left without critical equipment or supplies if the party should become separated. In addition, a multi-person tent may lack a desired level of privacy.

Individuals camping or traveling alone have relied on cramped one-person tents, bivouac sacks, and small tarps, foregoing many of the advantages of other shelters to avoid excessive weight and bulk. Bivouac sacks have long been used by mountaineers and climbers on narrow ledges and on steep or uneven terrain where even a one-person tent cannot be erected. Bivouac sacks are also carried by individuals for emergency use in case that person becomes separated from the rest of the party or is unable to reach other intended lodging before nightfall. However, if individual shelters of any type are used as the sole means of shelter, most group functions requiring shelter are difficult or impossible, including tending ill or injured persons. In addition, bivouac sacks tend to be less weather-resistant than tents, due to the lack of a formal suspension system to hold the fabric taut in a fixed structure and thus shed rain or snow, or deflect wind in a predictable and acceptable fashion.

Efforts to minimize the weight and bulk of equipment have included combining in a single device the functions of a shelter and some other piece of equipment. Toward this end, prior art has addressed a continuing need to effectively combine a shelter with some type of foul-weather apparel. Patents directed to devices of this type are the patents to Brecht and Sigesmond U.S. Pat. No. 36,685 (1862); Schaefer U.S. Pat. No. 2,745,105 (1956); Rolf et al. U.S. Pat. No. 4,594,735 (1986); and Yih et al. U.S. Pat. No. 5,217,034 (1993). Each of these devices, however, can be used only as one-person shelters and consequently have the disadvantages of bivouac sacks and other individual shelters discussed previously. The tent provided in the patent to Bossan, Jr. U.S. Pat. No. 1,895,991 (1933) can form a complete canopy only when combined with a second unit. The patent to Horn U.S. Pat. No. 2,093,889 (1937) provides a device that can be combined with other like devices to form larger shelters, but that also requires a minimum of two units to form a complete canopy. While the device in the patent to Gail U.S. Pat. No. 1,215,139 (1917) can be used as a tarp to form larger shelters, the resulting shelters do not provide full enclosure, as required in many situations. Additionally, each of the aforementioned devices employs a poncho or rain cape as foul-weather apparel, both of which provide little or no lower body protection and perform poorly in windy conditions.

Tarps provide greater versatility than tents or bivouac sacks, in that a lightweight tarp can be carried by an individual for use as an emergency shelter, such as a lean-to, then combined with others to shelter larger areas. Canoeists have used light-weight tarps as sails, in combination with canoes to form make-shift shelters, and as whitewater covers to gain some of the more seaworthy characteristics of kayaks. Tarps also have been stretched over improvised frames to form crude watercraft in emergency situations. Perhaps the most versatile design for a shelter device based on a tarp is the trail tent, published in the *Handbook for Boys* at least as long ago as 1948 by the Boy Scouts of America. However, this and other shelters improvised from tarps lack a suitable engaging means for fastening edges together to make them weatherproof, either as independent structures or in combination with others. This results in ineffective protection in many weather conditions, particularly with higher winds. The lack of a sealable engaging means also makes tarps ineffective at preventing entry of insects, ticks, scorpions, mice, and other small animals which may become pests. In addition, tarps have no provision for conversion to any type of foul-weather apparel.

Devices that combine a backpack and a tent are disclosed in patents to Armstrong U.S. Pat. No. 4,239,135 (1980); Ward U.S. Pat. No. 4,331,272 (1982); and Rowe U.S. Pat. No. 5,277,349 (1994). None of these devices, however has any provision for foul-weather apparel.

While tents, bivouac sacks, and tarps continue to be used as shelters, it is obvious that they have not, heretofore, been sufficiently versatile to serve well under many common circumstances. Efforts to combine the function of a shelter with the function of another article of outdoor equipment have generally resulted in devices that compromise both functions, and consequently perform neither function well. The versatility that these devices lack can be essential in providing a means to alleviate problems posed by weather or terrain, particularly in emergencies, unexpected circumstances, and strandings.

There has long been a need for an article of outdoor equipment that can be readily transported by an individual and used independently to form, as required, a tent, bivouac sack, tarp, weatherproof suit, backpack, or hull covering of a watercraft. There also is a need for a shelter system comprised of a plurality of units that can be fastened together to create a variety of shelters of different shapes and sizes for use in diverse circumstances. Such a system also is needed to meet requirements for greater efficiency and variety of use by providing greater headroom, floor area, and volume than would result from the same number of units either used as independent shelters or erected as contiguous adjacent structures. To my knowledge, no one has heretofore combined all of these functions and capabilities in a single invention.

OBJECTIVES AND ADVANTAGES

The primary objective of the present invention is to provide a versatile shelter system comprising a plurality of units that can be fastened together to create shelters of various shapes and sizes to suit specific needs in diverse circumstances involving both planned and emergency situations in outdoor settings.

It is also an objective of the invention to provide, as one of the units of the shelter system, a unit that can be:

(a) used alternatively as a tent, bivouac sack, tarp, fly, sail, signal panel, and ground cloth;

(b) converted to a weatherproof suit having defined sleeves, trouser legs, and hood, and capable of protecting at least one person and a large backpack from wind, rain, and snow while engaged in common outdoor activities;

(c) converted to a hull covering or skin that can be stretched over a suitable light frame of material such as wood, plastic, or tubular metal to form a kayak or other small watercraft; and (d) converted to a backpack suitable for use when a conventional backpack is unavailable.

Another objective of the invention is to provide, as another one of the units of the shelter system, a smaller complementary unit that can be used independently or in combination with other units to form a backpack, rain cape, pack cover, bag, tarp, fly, or ground cloth.

A further objective of the invention is to provide an alternative embodiment of each of the two unit types that provides a means for ventilating the shelter or item of apparel while excluding insects and other animal pests.

SUMMARY OF THE INVENTION

The invention comprises two panel units, a prime panel unit and a quarter panel unit, that form the basic structures of the invention. Each of the two panel unit types is comprised of a square panel of thin sheet material, an engaging means for fastening each of the four edges of the unit to other edges, and a plurality of attachment means at the corners, along the edges, and on at least one surface of the unit that are suitable for attaching cords, hooks, poles, pegs, rings, and other devices. Attachment means differ from engaging means in that attachment means provide only a single fastening point on the panel, while engaging means provide continuous fastening for a distance along the edge of the panel. The prime panel unit differs from the quarter panel unit principally in that the length of each side of the prime panel unit is twice the length of each side of the quarter panel unit.

Suitable engaging means comprise a first engaging means and a second engaging means that is engageable with the first engaging means. The first engaging means is disposed along one half of each edge of the prime panel unit from the middle of the edge to one of the adjacent corners. The second engaging means is disposed along the remaining half of each edge of the prime panel unit from the middle of the edge to the other adjacent corner. The engaging means are disposed such that when the prime panel unit is folded in half along either diagonal axis or along either axis that bisects two opposing parallel sides of the prime panel unit, each of the four first engaging means is juxtaposed appropriately to engage a second engaging means. The resulting arrangement of engaging means exhibits four-fold radial symmetry about the center of the prime panel unit and differs from prior art in this respect.

First engaging means are also disposed along two opposing edges of the quarter panel unit and second engaging means are disposed along the remaining two edges such that when the quarter panel unit is folded in half along either diagonal axis, each of the two first engaging means is juxtaposed appropriately to engage a second engaging means. The resulting arrangement of engaging means exhibits two-fold radial symmetry about the center of the quarter panel unit. This arrangement also allows four quarter panel units to be fastened together to form a construct with the same overall dimensions and same arrangement of engaging means along the edges as the prime panel unit.

The attachment means are arrayed in a regular and evenly-spaced grid of not less than five rows of five attachment means each on the prime panel unit. This arrangement of attachment means differs from prior art and is essential for constructing the articles described hereinafter. In utilizing the same regular spacing, attachment means of the quarter panel unit are arrayed in a grid of not less than three rows of three attachment means each. The geometry of the panel and the arrangement of attachment means for the prime panel unit and the quarter panel unit each exhibits four-fold radial symmetry about the center of the respective panel unit.

A particularly high degree of versatility is derived from the novelty of utilizing four-fold radial symmetry to provide a plurality of complementary functional elements that can be joined in numerous ways. For example, in the preferred embodiment, a single prime panel unit can be engaged in 48 different combinations of from one to four engaging means, exclusive of combinations that are mirror images of previous combinations or that can be rotated to exhibit a previous combination. By contrast, the quarter panel unit can be engaged in only two such different combinations due to the lesser versatility of the two-fold radial symmetry of the arrangement of its engaging means. The prime panel unit can be rotated into any one of four initial orientations in creating each combination, resulting in four variations on each combination. This provides the advantage, in the event of damage to a portion of a panel unit, that it is often possible to alleviate or minimize the effect of the damage by rotating the panel unit to an orientation in which the damaged portion is not performing an essential function.

The invention exceeds the capabilities of prior art by providing means for meeting all of the objectives previously stated. More specifically, the prime panel unit can be used individually in numerous configurations as a tent, bivouac sack, tarp, fly, sail, signal panel, ground cloth, weatherproof suit, skin or hull covering for a kayak, or as a backpack, as well as various other diverse items. A plurality of prime panel units can be fastened together to create larger and more diverse tents, tent modules, flies, and other items. A quarter panel unit can also be used individually or engaged with other quarter panel units to form such items as bags, pack covers, ground cloths, and rain capes. Various combinations of prime panel units and quarter panel units can be combined to form additional variations of all of these items that provide increased size, utility, and versatility.

Prime or quarter panel units constructed of insect netting material can be used to create insect exclosures or can be used as windows or ventilation panels in structures constructed otherwise with non-netting units. Quarter panel units can also be used as individual head nets, see-through bags, or dip nets.

Several modules of fixed form are provided that can be created from one or more panel units. Each end module consists of a fixed form and an opening on one end having the same geometry as at least one other type of module for coupling with other modules. Each double module has two such openings. Each half module consists of a form that can be coupled with a mirror image of itself to form an end module. These modules can be coupled in numerous configurations to form tents of various shapes and sizes.

A floored double module is provided that comprises three prime panel units in the form of a recumbent triangular prism having two identical openings. One of the prime panel units forms a floor. Each of the openings is a triangle formed from one edge of each of the three prime panel units. Similarly, a canopy double module is constructed in the same form but with only two prime panel units, omitting the third prime panel unit used as the floor in the floored double module, thereby allowing the floor width to vary to couple with modules having wider or narrower triangular openings.

The wedge end module and the ridge end module can each be formed with a single prime panel unit. Each of these end modules has an equilateral triangular opening that can be coupled with other modules having similar openings.

The box end module also can be formed with a single prime panel unit. It can be coupled with another box end module or with a canopy double module. The narrower width of its base prevents it from coupling directly with the aforementioned other types of end modules.

The room half module and the alcove half module each are formed from a prime panel unit engaged with a quarter panel unit. Each of these half modules is coupled with another half module that is a mirror image of the first half module to form an end module that can then be coupled with any other end module or double module having an equilateral triangular opening. Half modules can also be engaged with additional half modules and panel units in other configurations to form larger structures.

Additional forms of modules are possible and can be used to form even larger and more diverse structures. The examples shown herein are intended to demonstrate sufficiently the versatility of the invention and the modular nature of many of the possible constructs.

A more complete understanding of the features, objectives, and advantages of the present invention may be had from a consideration of the following detailed description taken in conjunction with the accompanying drawings.

DETAILED DESCRIPTION—FIGS. 1–4

Figure 1:
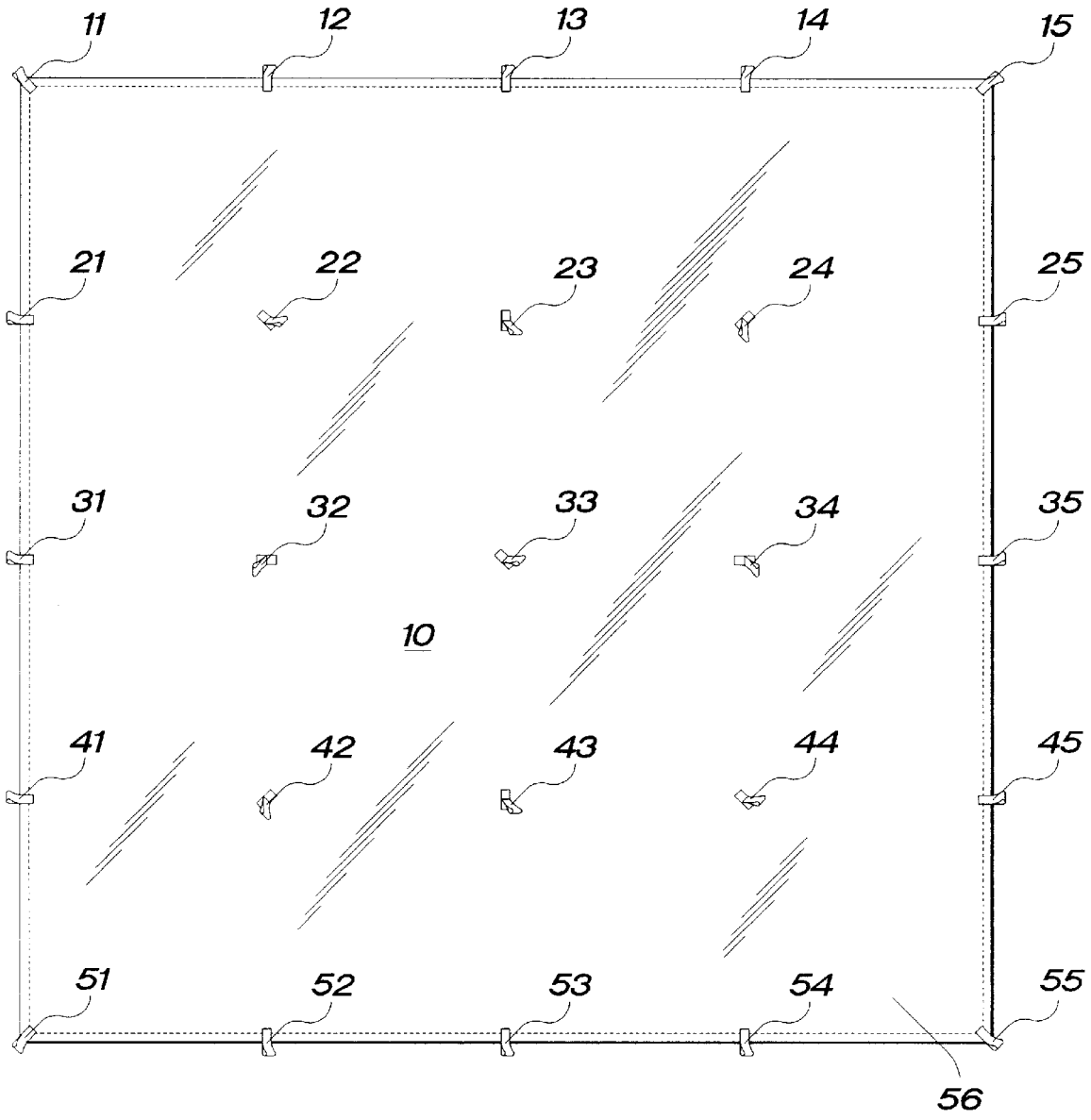
FIG. 1 is a plan view of the top surface of the prime panel unit.

Referring initially to FIG. 1, a plan view of the top surface of the preferred embodiment of a prime panel unit 10 shows the preferred arrangement of attachment means 11–15, 21–25, 31–35, 41–45, and 51–55 fastened to a square panel 56 of thin sheet material in a regular geometric pattern of five rows of five attachment means each, including attachment means at each of the four corners of prime panel unit 10. In the preferred embodiment, the thin sheet material is a lightweight nylon fabric having a waterproofing means such as a polyurethane coating or film of PTFE. The prime panel unit can be used for signalling, using standard liferaft sail signals, when constructed of a PTFE-laminate fabric or other fabric in which the color of the lower surface of the fabric contrasts markedly with the color of the upper surface. Liferaft sail signals are formed by folding the panel to expose parts of one or both sides of the panel in prescribed patterns, and displaying the panel to be visible from a search aircraft.

Attachment means in the preferred embodiment consist of loops of webbing fastened to panel units by sewing or other suitable means. Attachment means are arrayed in a regular and evenly-spaced grid of five rows of five attachment means each on prime panel unit 10, exhibiting four-fold radial symmetry. This arrangement of attachment means differs from prior art and is essential for constructing articles described hereinafter.

In this view, prime panel unit 10 clearly has the characteristics of a tarp. Consequently, it can be used in the ways in which tarps have been used in the past for outdoor activities. This includes covers for various items, makeshift sails, lean-tos, flies, and ground cloths.

Figure 2:
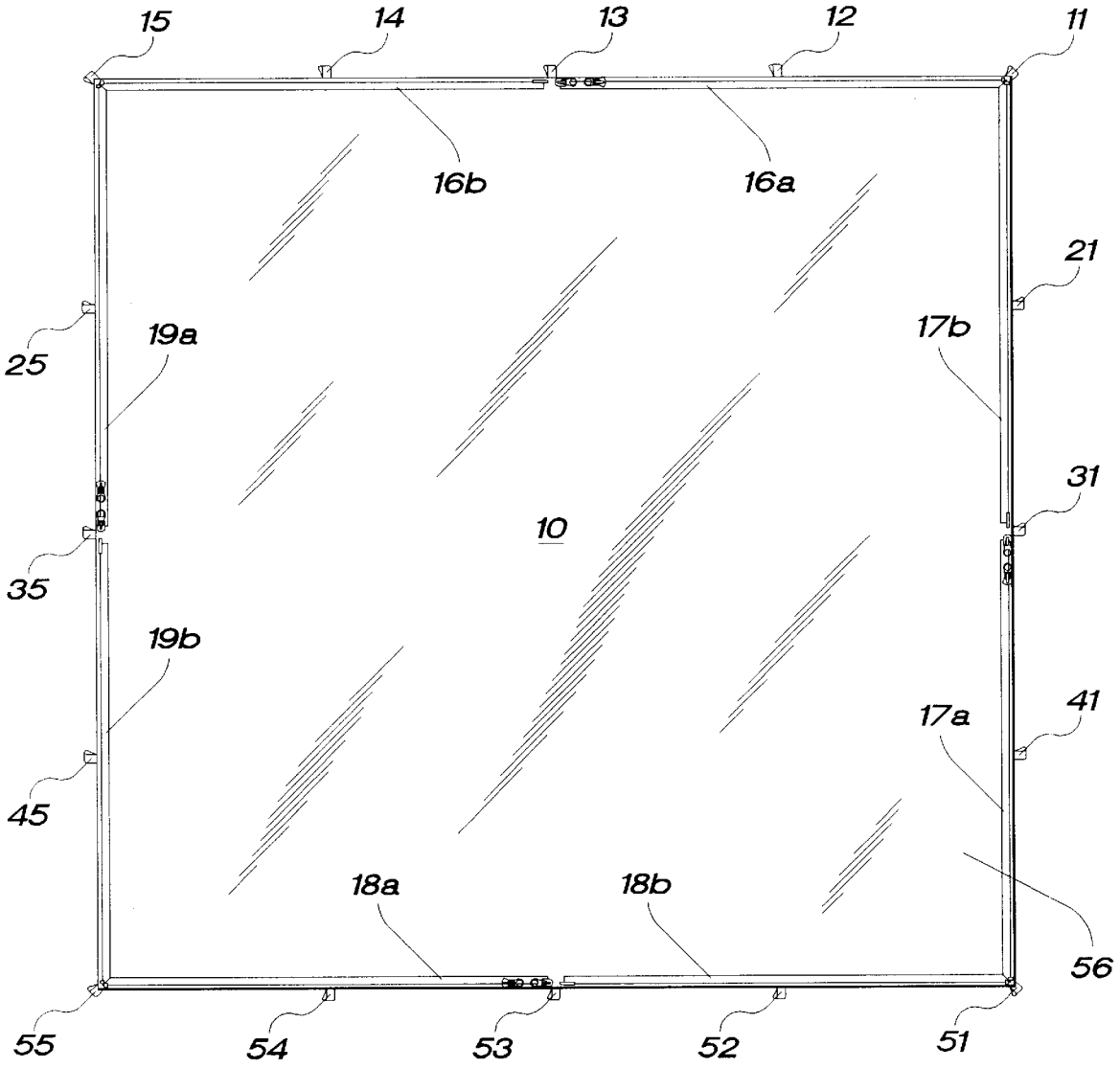
FIG. 2 is a plan view of the under surface of the prime panel unit.

In the preferred embodiment, separating zippers with double sliders and double pull tabs comprise the engaging means as shown in a plan view of the underside of prime panel unit 10 illustrated in FIG. 2. Double sliders allow zippers to be opened at either end. This capability increases ventilation options and is essential for forming sleeve openings when prime panel unit 10 is configured as a weatherproof suit. Double pull tabs allow zippers to be operated from both inside and outside of various constructions.

Each zipper further comprises a first engaging means consisting of a zipper track with sliders and appropriate stops, and a second engaging means consisting of a zipper track without sliders and engageable with the first engaging means. All zipper tracks are of identical size and length to allow any zipper track with sliders to be engaged with any zipper track without sliders. Reference numerals pertaining to zipper tracks with sliders are designated with an (a) suffix and reference numerals for zipper tracks without sliders are designated with a (b) suffix. Zipper tracks with sliders 16*a*, 17*a*, 18*a*, and 19*a* are each disposed along one edge of prime panel unit 10 together with one zipper track without sliders 16*b*, 17*b*, 18*b*, and 19*b*. Each zipper track has its starting end located at the middle of the edge, extends to the adjacent corner of prime panel unit 10 and is fastened in place by sewing or other suitable means. For example, zipper track 18*a* extends from attachment means 53 to attachment means 55 and zipper track 18*b* extends from attachment means 53 to attachment means 51. The starting end for engaging each of these zipper tracks is the end near attachment means 53, at the middle of the edge. The remaining zipper tracks are arrayed in a similar fashion along all three other edges, resulting in a pattern having four-fold radial symmetry about the center of panel 56. Attachment means 11–15, 21, 25, 31, 35, 41, 45, and 51–55 are identified in FIG. 2 to show the position of each of the zipper tracks in relation to the array of attachment means.

Figure 3:
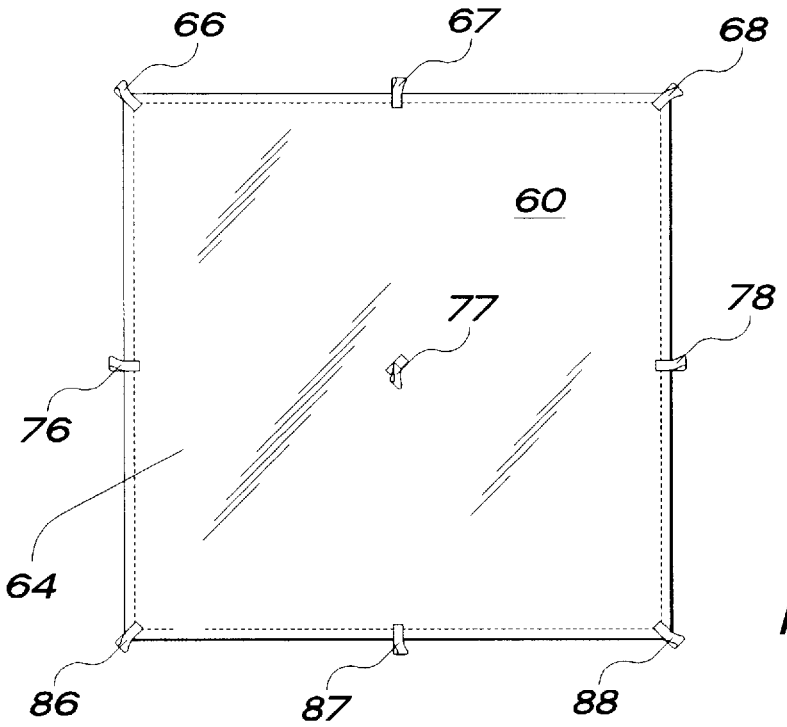
FIG. 3 is a plan view of the top surface of the quarter panel unit.

FIG. 3 is a plan view of the top surface of a quarter panel unit 60 showing the preferred arrangement of attachment means 66–68, 76–78, and 86–88 fastened to a square panel 64 of thin sheet material in a regular geometric pattern of three rows of three attachment means each, including attachment means at each of the four corners of quarter panel unit 60. This pattern results in the same spacing of attachment means as on prime panel unit 10 and four-fold radial symmetry of these design elements.

Figure 4:
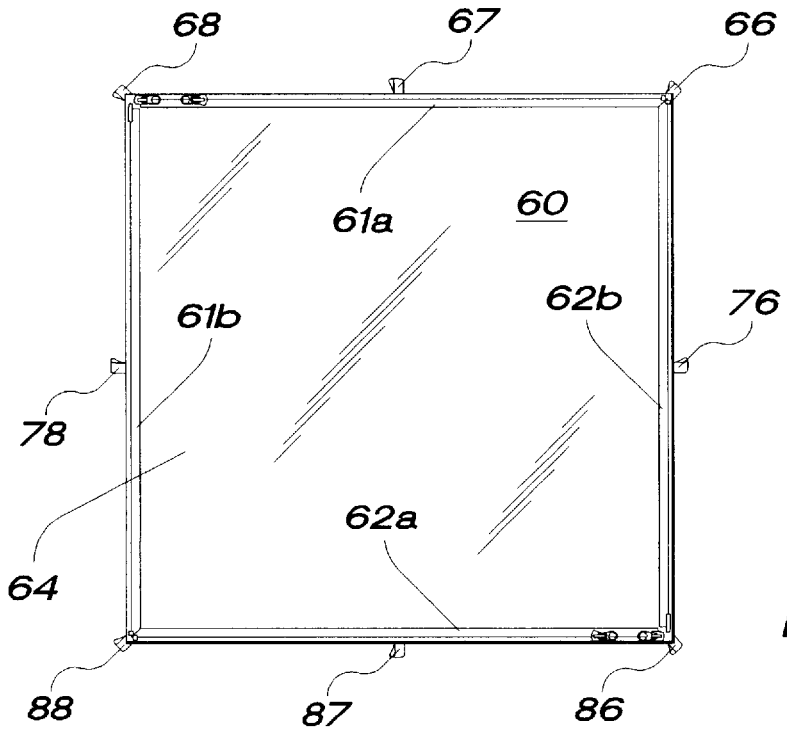
FIG. 4 is a plan view of the under surface of the quarter panel unit.

The under surface of quarter panel unit 60, illustrated in plan view in FIG. 4, shows the placement of zipper tracks with sliders 61*a* and 62*a* and zipper tracks without sliders 61*b* and 62*b*. Due to the smaller size of panel 64, quarter panel unit 60 has a single zipper track disposed along each edge in a two-fold radially symmetrical pattern. Each zipper track with sliders (a) starts at a corner shared with the starting end of a zipper track without sliders (b) and extends the length of the side. Consequently zipper tracks 61*a* and 61*b* both have starting ends at attachment means 68. Zipper track 61*a* then extends along the edge of panel 64 to attachment means 66, while zipper track 61*b* extends to attachment means 88. Similarly, zipper tracks 62*a* and 62*b* both have starting ends at attachment means 86. Zipper track 62*a* then extends along the edge of panel 64 to attachment means 88, while zipper track 62*b* extends to attachment means 66. Attachment means 67, 76, 78, and 87 are identified in FIG. 4 to further show the position of each of the zipper tracks in relation to the array of attachment means.

All zipper tracks on both prime panel unit 10 and quarter panel unit 60 are of identical size and length to allow any zipper track with sliders to be engaged with any zipper track without sliders. Zipper tracks are offset parallel to panel edges a sufficient distance to provide a small amount of overlap of panel edges when fastened together. The overlap inhibits wind and water from reaching and leaking through fastened zippers and also prevents insects from entering through openings at the zipper ends. At the starting ends, zipper tracks are also separated from each other a sufficient amount to allow clearance to engage the slider with the adjacent zipper track.

In an alternative embodiment, the thin sheet material for either type of panel unit comprises a screen mesh or insect netting material for providing ventilation while excluding insects and small pests.

OPERATION AND USES—FIGS. 5–46

The following examples are provided to demonstrate the use of the invention in meeting the objectives previously stated. Numerous other methods for using the invention to meet these objectives are possible and anticipated.

Due to the four-fold radial symmetry of prime panel unit 10, four different orientations of prime panel unit 10 can be used to produce the same form. Similarly, the two-fold symmetry of quarter panel unit 60 provides two possible orientations which can be used to produce the same form. Only one such orientation for each unit will be used in the following descriptions.

Figure 5:
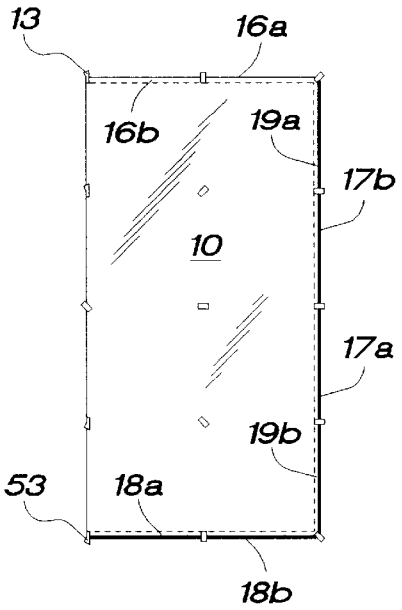
FIG. 5 is a plan view of the prime panel unit configured as a rectangular bivouac sack.
Figure 7:
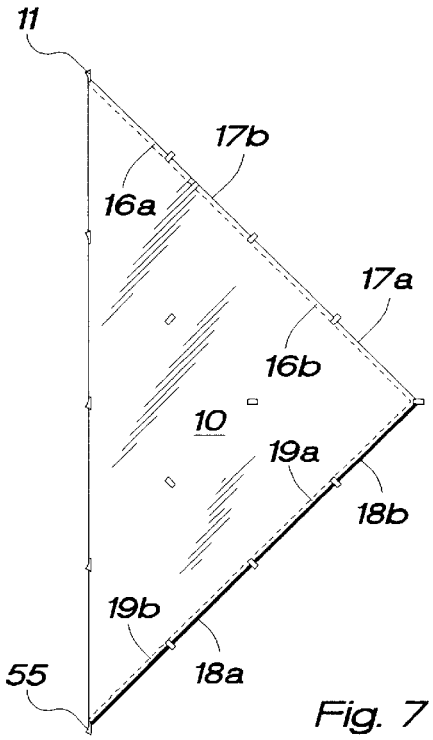
FIG. 7 is a plan view of the prime panel unit configured as a triangular bivouac sack.
Figure 6:
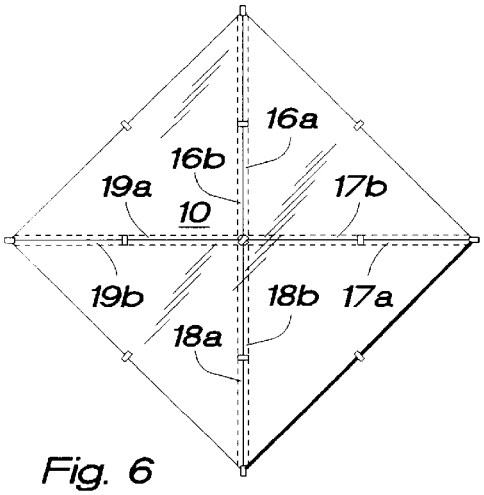
FIG. 6 is a plan view of the prime panel unit configured as a square bivouac sack.

Beginning with examples of some simple enclosures, FIGS. 5–7 are plan views of four types of fully-enclosable bivouac sacks that can be fashioned from a prime panel unit 10. A rectangular enclosure, illustrated in plan view in FIG. 5, is fashioned by folding prime panel unit 10 along an axis formed by attachment means 13 and 53, and fastening together zipper tracks 16*a* and 16*b*, 19*a* and 17*b*, 17*a* and 19*b*, and 18*a* and 18*b*. A square bag illustrated in plan view in FIG. 6 is fashioned by drawing all four corners of prime panel unit 10 together at the center of the unit, then fastening together zipper tracks 16*a* and 16*b*, 17*a* and 17*b*, 18*a* and 18*b*, and 19*a* and 19*b*. A triangular bag shown in FIG. 7 is fashioned by folding prime panel unit 10 along the diagonal axis formed by attachment means 11 and 55, and fastening together zipper tracks 16*a* and 17*b*, 17*a* and 16*b*, 19*a* and 18*b*, and 18*a* and 19*b*. This form may be particularly useful for providing weather protection for single-point suspension hammocks such as those used by rock climbers on high-angle rock walls. Any or all of the zippers on each enclosure can be used for ventilation and for access to the interior. These enclosures can also be used as covers or bags to store supplies and other equipment such as a bicycles or sleeping bags.

Figure 8:
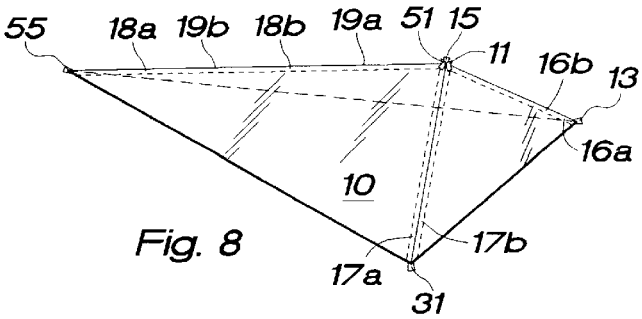
FIG. 8 is a perspective view of the prime panel unit configured as a bivouac sack that can be set up as a tent.

Another form of bivouac sack can be created from prime panel unit 10 as illustrated in perspective view in FIG. 8. This structure is formed by bringing together and fastening zipper tracks 16*a* and 16*b*, 17*a* and 17*b*, 18*a* and 19*b*, and 19*a* and 18*b*. In addition, this structure can be converted into a low-profile tent by fastening attachment means 13, 31, and 55 to the ground with stakes or other suitable means, stretching the intervening material taut, and then raising and supporting either one or two of attachment means 11, 15, or 51, with a vertical pole or other suitable supporting means (not shown) to bring the rest of the structure taut. In forming this tent and any of the following enclosures, at least one zipper should be partially open while raising the structure to allow air to enter the interior and passively inflate the structure.

Figure 9:
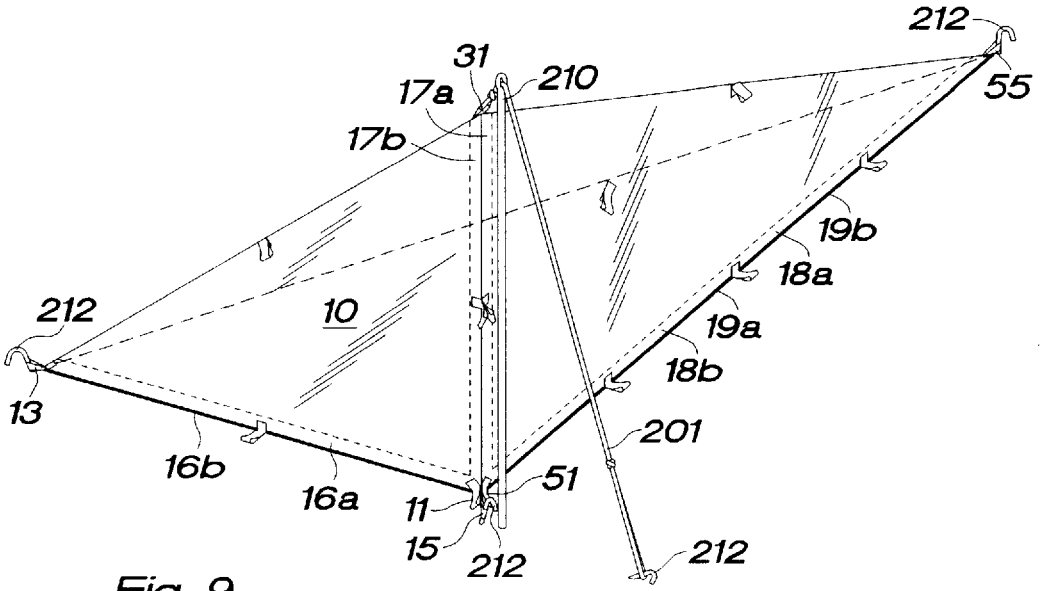
FIG. 9 is a perspective view of a tent constructed from the prime panel unit.

FIG. 9 is a perspective view of a fully enclosed tent with greater headroom and more weatherproof zipper placement. This structure is formed from the same basic structure as the tent in FIG. 8, but rotates the structure to use the floor of the structure in FIG. 8 as the roof of the structure in FIG. 9 by fastening attachment means 13, 15, and 55 to the ground with stakes 212 or other suitable means, stretching the intervening material to lie flat and smooth against the ground. The enclosure is then formed by fastening together zipper tracks 16*a* and 16*b*, 17*a* and 17*b*, 18*a* and 19*b*, and 19*a* and 18*b* as for the tent in FIG. 8. A supporting system is then used to raise and support attachment means 31 directly over the corner shared by attachment means 11, 15, and 51. The supporting system illustrated in FIG. 9 comprises a pole as a supporting means 210 and a taut rope as a fastening means 201 having one end fastened to attachment means 31 and the opposite end fastened to the ground with a stake 212, and the intervening portion of the rope supported by pole 210, thereby applying tension in a direction that raises and stretches the entire upper structure of the tent to a taut condition. Numerous other types of supporting systems can be used. The interior of the tent is accessed from either the side or the end wall by opening various combinations of zippers.

Additional attachment means along the edges in contact with the ground surface on this and all other tents formed with this invention provide additional points at which to fasten the tent securely to the ground, further preventing wind, precipitation, debris, and animals from getting under the walls or floor of the tent. Likewise, attachment means on the side surfaces of the tents provide a means to extend the sides outward to increase interior room or to provide additional support to hold the material more rigidly and tautly to improve performance in wind, rain, and snow.

Figure 10:
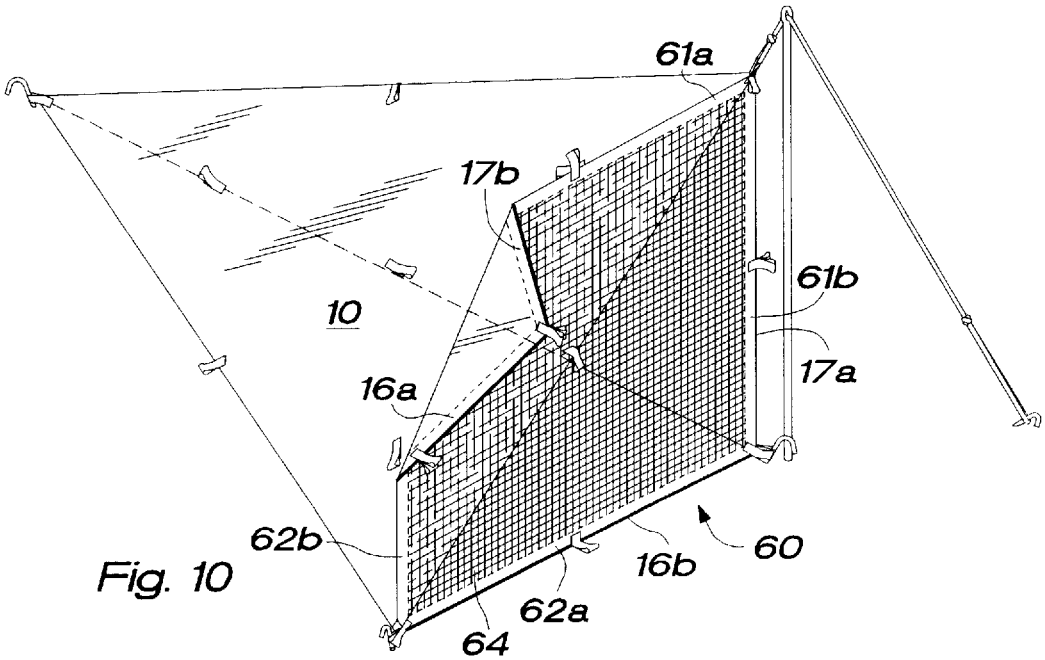
FIG. 10 is a perspective view of the tent of FIG. 9 with the quarter panel unit fastened at the end opening.

Another perspective view of the same tent form is illustrated in FIG. 10, with the addition of quarter panel unit 60, having panel 64 constructed of insect netting material, fastened at the end opening, thereby forming an insect-proof window and ventilation panel. In this example, quarter panel unit 60 is engaged with prime panel unit 10 by fastening together zipper tracks 61*a* and 17*b*, 17*a* and 61*b*, 16*a* and 62*b*, and 62*a* and 16*b*. Quarter panel units can also be used to form similar netting panels along the side of the tent.

A number of open structures are provided that have symmetrical openings of identical geometry and dimensions. These structures form modules that can be used independently or coupled with other modules to form tents and open shelters in a wide variety of sizes and shapes to meet the needs of diverse circumstances. End modules have a single opening suitable for coupling with other modules whereas double modules have two such openings.

Figure 11:
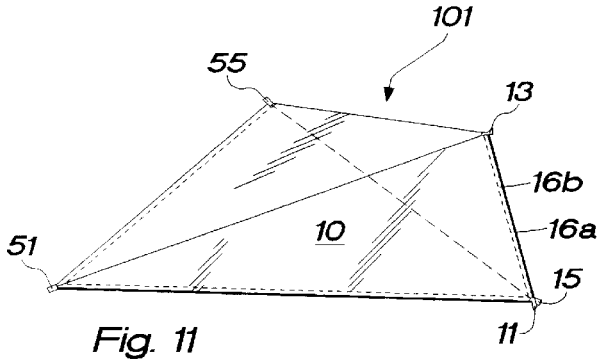
FIG. 11 is a perspective view of the wedge end module configured as a tent.
Figure 12:
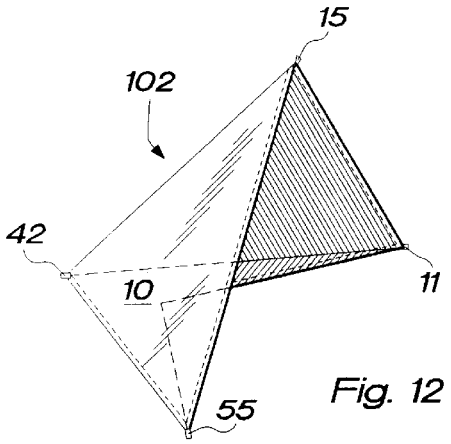
FIG. 12 is a perspective view of the ridge end module configured as an open shelter.
Figure 13:
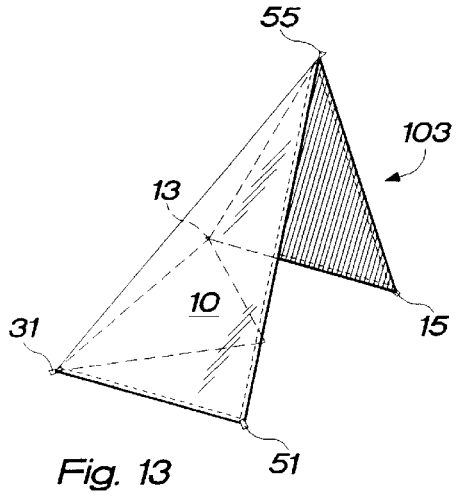
FIG. 13 is a perspective view of the box end module configured as an open shelter.

FIGS. 11–13 illustrate three end modules that can each be formed from a single prime panel unit 10. A wedge end module 101 illustrated in FIG. 11 is shown configured as a tent formed by fastening together zipper tracks 16*a* and 16*b*, then fastening to the ground attachment means 51, 55, and either attachment means 11 or 15, stretching the intervening panel edges taut, then raising and supporting attachment means 13 with a suitable supporting system (not shown) to form a roof, sides, and ridges. The base of this tent forms an equilateral triangle, each side of which is a edge of a prime panel unit 10, and therefore comprises a pair of zipper tracks that can be engaged with zipper tracks of any other module having an opening with a similar configuration.

A ridge end module 102 illustrated in FIG. 12 is shown as an open shelter with a partial floor, formed by fastening attachment means 11 and 55 to the ground separated by a distance equal to the length of one side of a prime panel unit 10, then fastening attachment means 42 to the ground, stretching the intervening edges taut, and finally raising and supporting attachment means 15 with a suitable supporting system (not shown) to make the roof surfaces and ridge taut. This forms a front opening that is an equilateral triangle that can be coupled with any other ridge end module or other type of module having this same type of opening, or with any two edges of a wedge end module opening or other similar opening.

Figure 14:
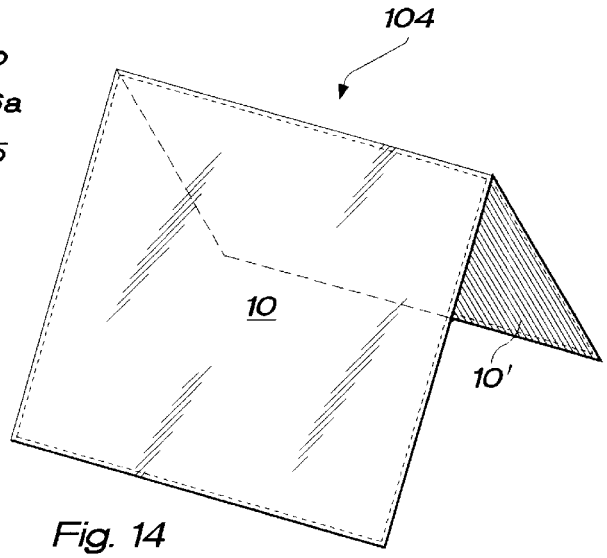
FIG. 14 is a perspective view of the canopy double module configured as an open shelter.

A box end module 103 illustrated in FIG. 13 is also shown as an open shelter with a partial floor. This module is formed by first fastening in order attachment means 51, 31, 13, and 15 to the ground to form a rectangle, stretching the three intervening edges taut, then raising and supporting attachment means 55 to make roof surfaces and ridges taut, using a suitable supporting system (not shown). Although box end module 103 also has a triangular opening, the base of the triangle is of lesser length than other end modules. Consequently, box end module 103 cannot be directly coupled with either wedge end module 101 or ridge end module 102, but can be coupled with canopy double module 104, illustrated in FIG. 14 in a perspective view.

A canopy double module 104 comprises two prime panel units 10, 10' engaged along one edge of each and configured such that the common edge forms a horizontal ridge at some distance above the ground and two prime panel units 10, 10' extend downward and outward from each other to form two taut roof sections and an opening at either end of the structure. The two edges at either end can be coupled with another canopy double module 104 or any of the three previously described end modules in various combinations.

Figure 15:
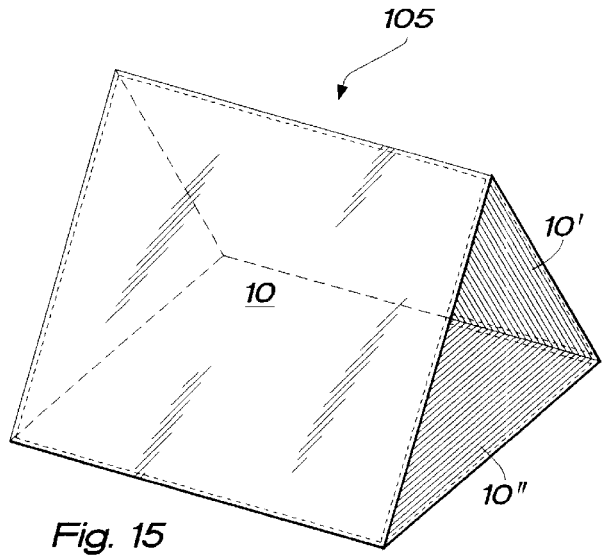
FIG. 15 is a perspective view of the floored double module configured as an open shelter.

A second form of double module, a floored double module 105 illustrated in FIG. 15, comprises the basic form of a canopy double module from prime panel units 10 and 10' with the addition of a third prime panel unit 10" as a floor. Openings at either end of the floored double module 105 are of the same structure as openings of wedge end module 101 and ridge end module 102 and therefore these modules can be coupled together or with either type of double module. In addition, because the floor of floored double module 105 need not be taut to function as an effective floor, floored double module 105 can also be coupled with box end module 103. Two or more double modules also can be coupled together to form larger structures.

Figure 16:
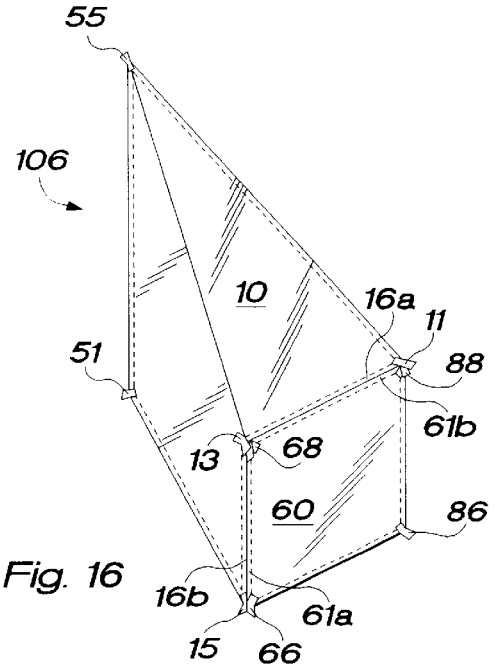
FIG. 16 is a perspective view of the alcove half module.
Figure 17:
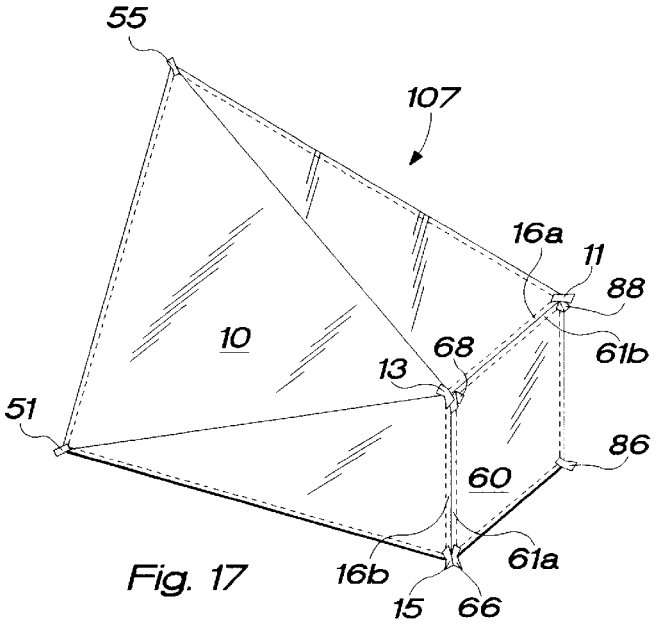
FIG. 17 is a perspective view of the room half module.

Two half modules illustrated in FIGS. 16 and 17 are shown as shells suitable primarily for shelter from sun and wind. Although half modules do not have a symmetrical opening suitable for coupling to other modules, an end module with an appropriate symmetrical opening is formed by coupling a half module with a second half module that is the mirror image of the first. As illustrated in both FIGS. 16 and 17, each half module is comprised of one prime panel unit 10 and one quarter panel unit 60 engaged by fastening together zipper tracks 16*a* and 61*b* and zipper tracks 61*a* and 16*b*. The common features of either structure are formed by first fastening attachment means 51, 15, and 66 to the ground, stretching the intervening edge of prime panel unit 10 taut between attachment means 51 and 15 to form a long side of the structure, then fastening attachment means 86 to the ground while stretching the intervening edge of quarter panel unit 60 taut at a right angle to the long side of the structure, and then separately raising and supporting attachment means pairs 13 and 68, and 11 and 88 such that quarter panel unit 60 forms a vertical wall and the lower portion of the structure is held taut using suitable support systems (not shown). At this point, the structure of the two modules diverges. An alcove half module 106, illustrated in FIG. 16, is formed by then raising attachment means 55 directly above attachment means 51, and supporting it with a suitable supporting system (not shown), making the entire structure taut and creating a ridge between attachment means 13 and 55. A room half module 107, illustrated in FIG. 17, is formed by raising attachment means 55 to a point where the entire structure is taut, ridges are formed between attachment means 13 and 53, and 13 and 51, and when viewed from above, as in a plan view, a right angle is created at the intersection of the edge between attachment means 51 and 55 and the edge between attachment means 55 and 11.

Figure 18:
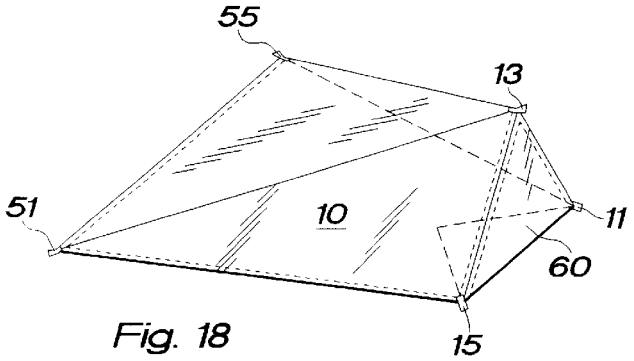
FIG. 18 is a perspective view of a modification of the room half module configured as a tent.

The basic form of room half module 107 can be modified to provide a tent, as illustrated in FIG. 18. This tent is formed by fastening together one primary panel unit 10 and one quarter panel unit 60 in the manner described above for the two half modules, then fastening attachment means 11, 15, 51, and 55 to the ground while stretching the intervening edges taut in the form of a trapezoid, and then raising and supporting attachment point 13 to make the roof, end, and ridges taut using a suitable supporting system (not shown).

Figure 19:
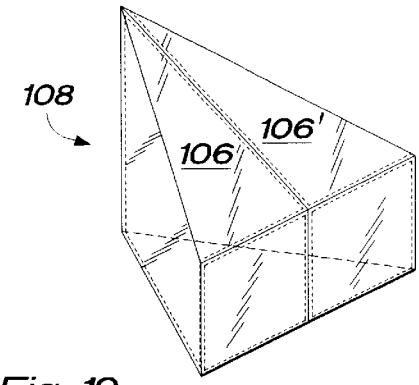
FIG. 19 is a perspective view of the alcove end module.
Figure 20:
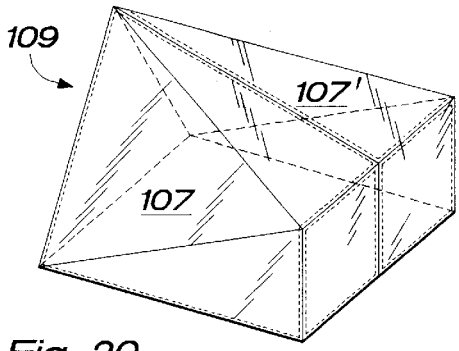
FIG. 20 is a perspective view of the room end module.
Figure 21:
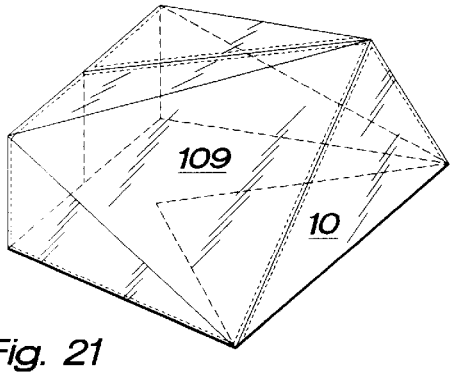
FIG. 21 is a perspective view of a tent formed by adding a prime panel unit to a modification of the room end module.
Figure 22:
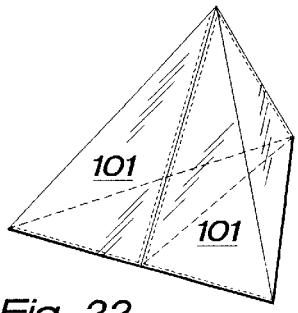
FIG. 22 is a perspective view of a pyramidal tent with a triangular base formed from two wedge end modules.
Figure 23:
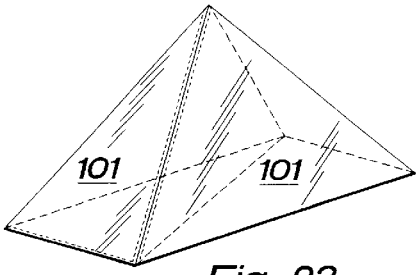
FIG. 23 is a perspective view of a pyramidal tent with a parallelogram-shaped base formed from two wedge end modules.

Alcove half module 106, when coupled with a second alcove half module 106' formed as a mirror image of the first half module, creates a tent and alcove end module 108, depicted in FIG. 19. The base of the resulting structure is an equilateral triangular opening. In a similar fashion, two room half modules 107, 107' couple to form an open shelter and room end module 109, as illustrated in FIG. 20, having an end opening that is also an equilateral triangle. Due to having similar openings, each of these end modules can be coupled with each other or any of the other modules previously described with the exception of box end module 103 to make additional tents. As illustrated in FIG. 21, room end module 109 can also be modified to form a tent by coupling two adjacent edges of a prime panel unit 10 with the two edges of the end opening of room end module 109, then lowering the peak of the tent while extending the two lower corners of prime panel unit 10 equal distances in opposite directions laterally to stretch the intervening material taut.

Figure 24:
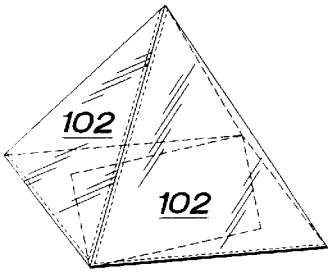
FIG. 24 is a perspective view of a pyramidal tent with a diamond-shaped base formed from two ridge end modules.
Figure 25:
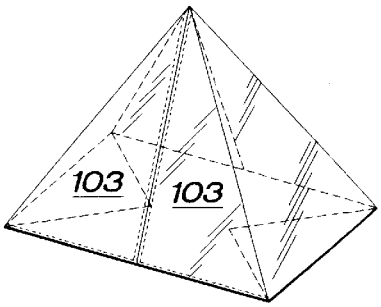
FIG. 25 is a perspective view of a pyramidal tent with a rectangular base formed from two box end modules.

FIGS. 22–25 illustrate a variety of pyramidal tents that demonstrate one aspect of the versatility of the invention in that each is constructed from two prime panel units in the form of a pair of similar end modules. However, each has a different basal shape and amount of floor coverage. A tetrahedral tent illustrated in FIG. 22 comprises two wedge end modules 101 which are mirror images of each other, coupled to form a tent with a full triangular floor. Another tent illustrated in FIG. 23 comprises two identical wedge end modules 101 coupled such that they face in opposite directions, resulting in a tent with a full floor in the shape of a parallelogram. Two ridge end modules 102 couple, as shown in FIG. 24, to form a pyramidal tent with a partial floor and diamond-shaped base. Likewise, two room-end modules 103 couple, as shown in FIG. 25, to form a pyramidal tent with a partial floor and a rectangular base.

Figure 26:
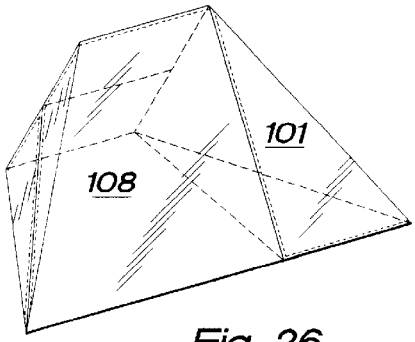
FIG. 26 is a perspective view of a tent formed from the alcove end module and the wedge end module.
Figure 27:
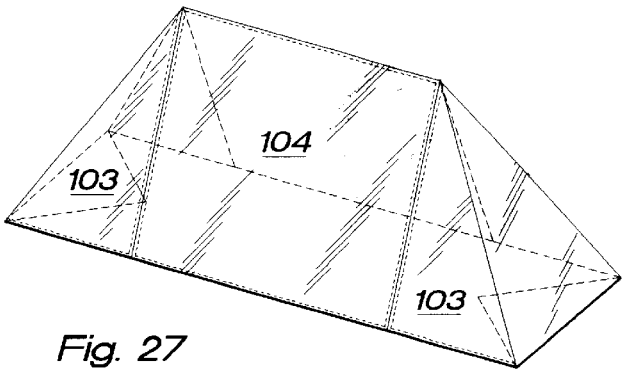
FIG. 27 is a perspective view of a tent formed from two box end modules and the canopy double module.
Figure 28:
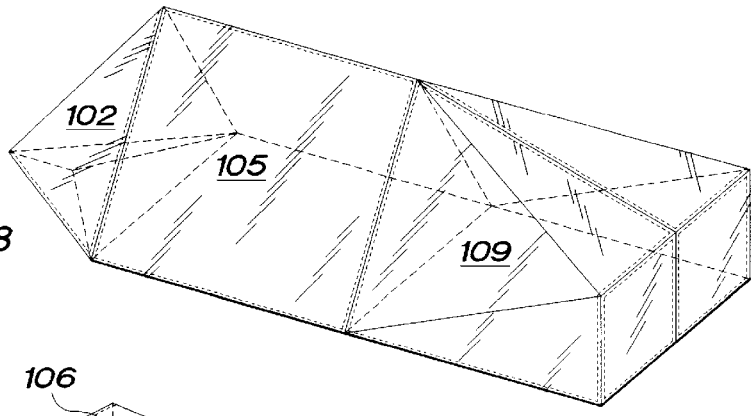
FIG. 28 is a perspective view of a tent formed from the ridge end module, the floored double module, and the room end module.

FIGS. 26–28 illustrate three diverse tent styles that include at least one possible use of each of the modules previously described. One use of an alcove end module 108 is illustrated in FIG. 26, wherein it is coupled with a wedge end module 101, to form a tent having a short horizontal ridge and a trapezoidal floor. A relatively long and narrow tent with a rectangular floor, high ridge, and steep roof panels is illustrated in FIG. 27, formed from two box end modules 103 coupled to either end of a canopy double module 104. A tent, illustrated in FIG. 28, is constructed from the three remaining types of modules by coupling ridge end module 102 and room end module 109 to opposite ends of floored double module 105. Numerous other combinations of these modules are possible.

Figure 29:
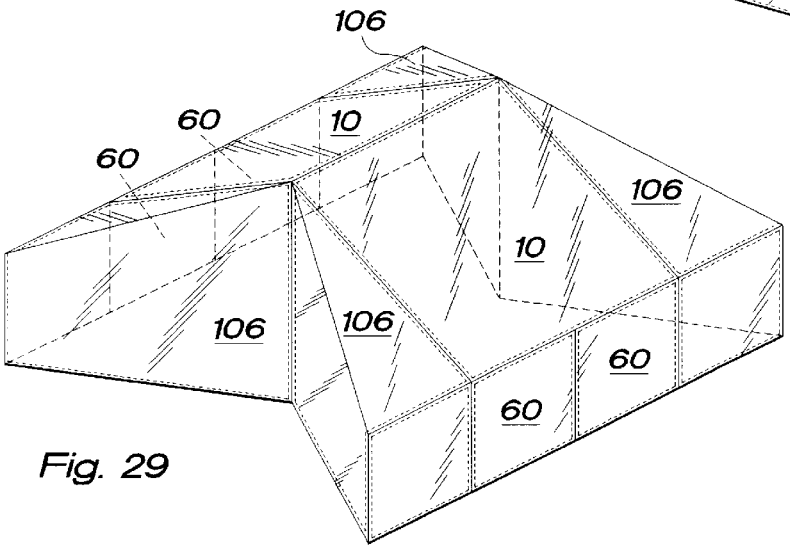
FIG. 29 is a perspective view of a tent formed from four alcove end modules together with two additional prime panel units and four additional quarter panel units.

FIG. 29 illustrates a design that uses a half module to form the basic structure for constructing a large symmetrical tent in conjunction with additional panel units. In this example, alcove half modules 106 are used to form each of the four corner sections of the tent. The central roof section of the tent is formed by two prime panel units 10 engaged at the ridge, and further engaged with the four alcove half modules 106 along the adjacent edges. Four quarter panel units 60 engage with the lower edges of the central roof section, and with the edges of adjacent quarter panel units 60 to complete the lower wall of the tent. A similar tent (not shown) having a larger square base and lower roof angle can be formed by substituting a room half module 107 for each alcove half module 106.

Figure 30:
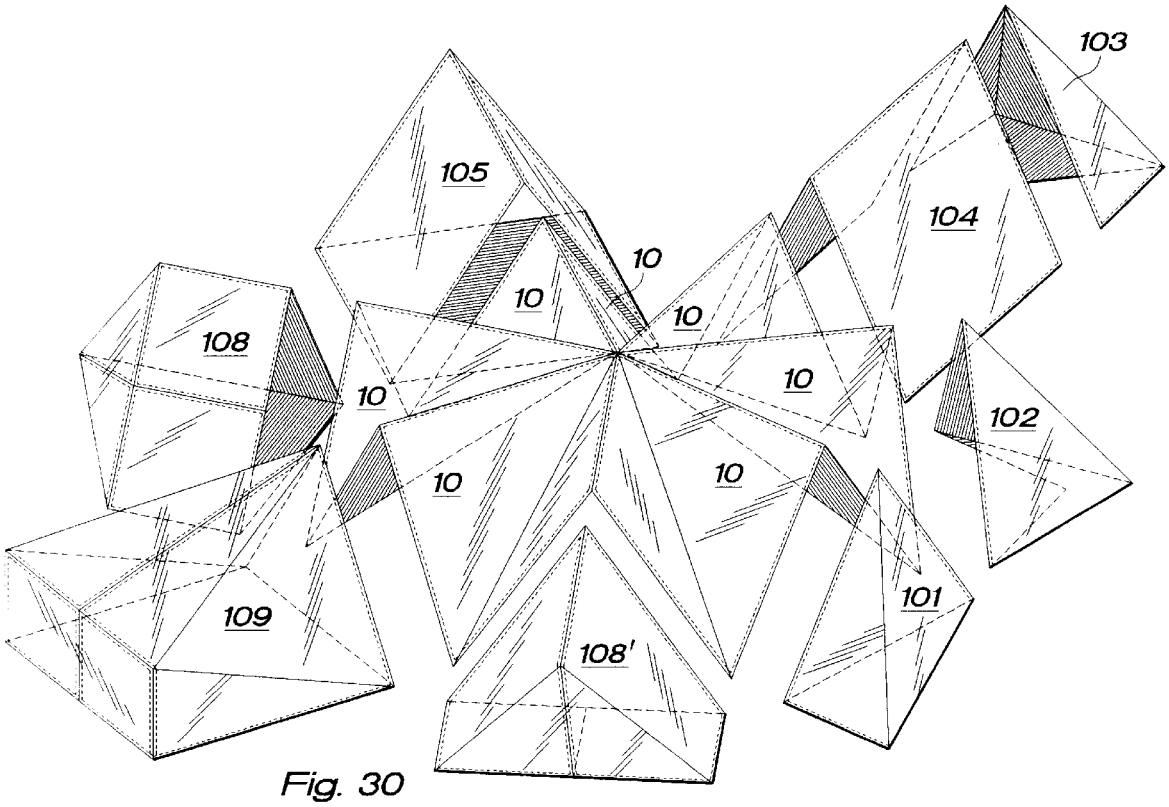
FIG. 30 is an exploded view in perspective of a large tent formed from a complex central hub and eight modules.

A large tent illustrated in an exploded view in FIG. 30 combines a seven-sided hub formed from seven prime panel units 10 with modules 101, 102, 103, 104, 105, 108, 109, and 108'. The hub is formed by fastening together each of two adjacent edges of each of seven prime panel units 10 such that all seven units have one corner in common. Each of the seven corners diagonal to the common corner are fastened to the ground surface in radial sequence at a distance equal to the length of one side of prime panel unit 10 from both a common central point and from the previously fastened corner for all but the first corner. The resulting distance between the first and last corners fastened will be somewhat less than the length of one side of prime panel unit 10. The hub structure is then formed by raising and supporting the attachment means at the common corner and the attachment means at the opposite ends of each of the engaged zippers, making the entire structure taut. Of the seven resulting openings, the narrower opening is suitable for coupling only with box end module 103 or canopy double module 104. The other six openings are suitable for coupling with any other type of end modules and both types of double modules.

The orientation of alcove end module 108' in this example provides an overhanging wall on the end of the module opposite the hub. The advantage of this orientation is that the overhang provides protection from precipitation while zippers on the wall are used to provide access to the interior of the tent.

Figure 31:
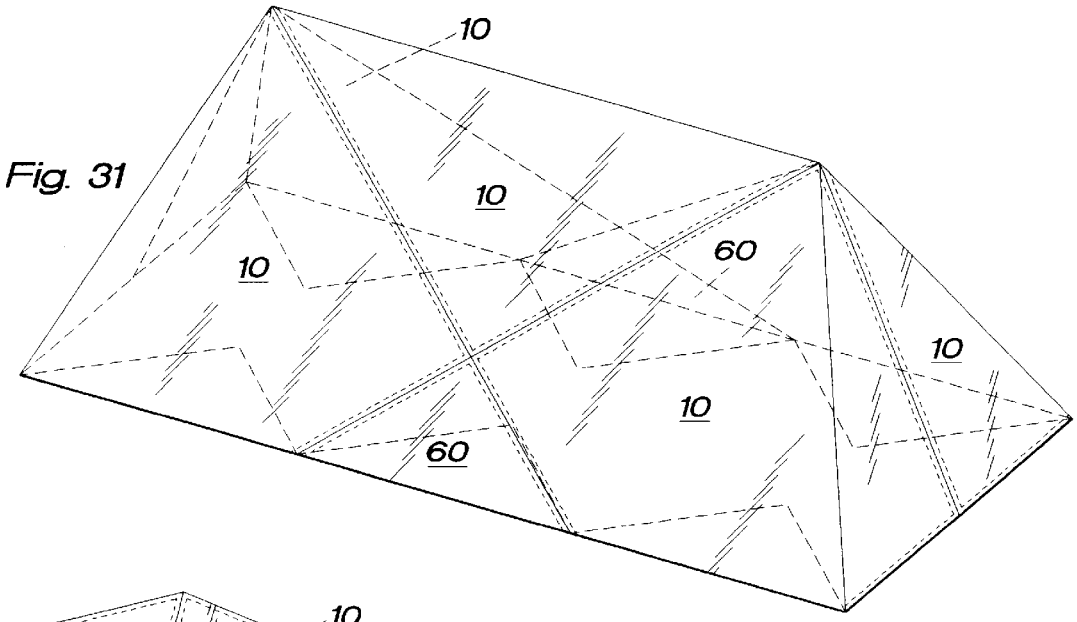
FIG. 31 is a perspective view of a tent formed from five prime panel units and two quarter panel units.

Tents that have similar geometry to each other, but that differ in size, can also be created. The geometric form of the tent illustrated in FIG. 31 and formed from five prime panel units 10 and two quarter panel units 60 is similar to that of the smaller tent illustrated in FIG. 27 which is formed from four prime panel units 10.

Figure 32:
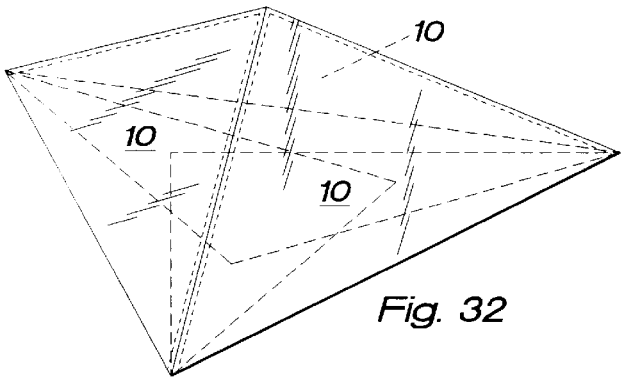
FIG. 32 is a perspective view of a pyramidal tent with a triangular base formed from three prime panel units that overlap at the base to form a floor.
Figure 33:
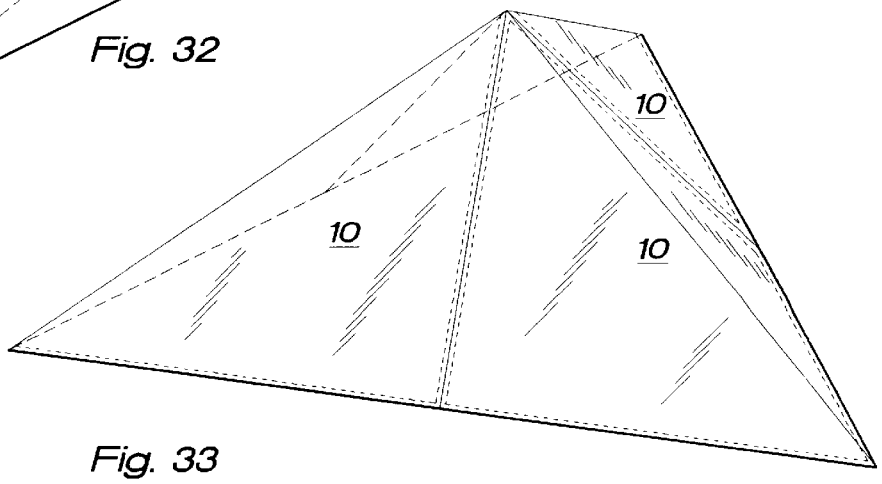
FIG. 33 is a perspective view of a pyramidal tent with a triangular base and no floor formed from three prime panel units.

In another example, two types of tent with similar geometric form can be constructed from a basic three-panel canopy. FIG. 32 shows a pyramidal tent that has an equilateral triangular base that is covered by half of each of three prime panel units 10 to form a tent with a full floor. Another tent, illustrated in FIG. 33, is formed from three prime panel units 10 into a canopy that has the same geometric form as the canopy of the tent shown in FIG. 32 but that differs in that it covers twice as much area, has a higher peak, and does not have a floor.

Figure 34:
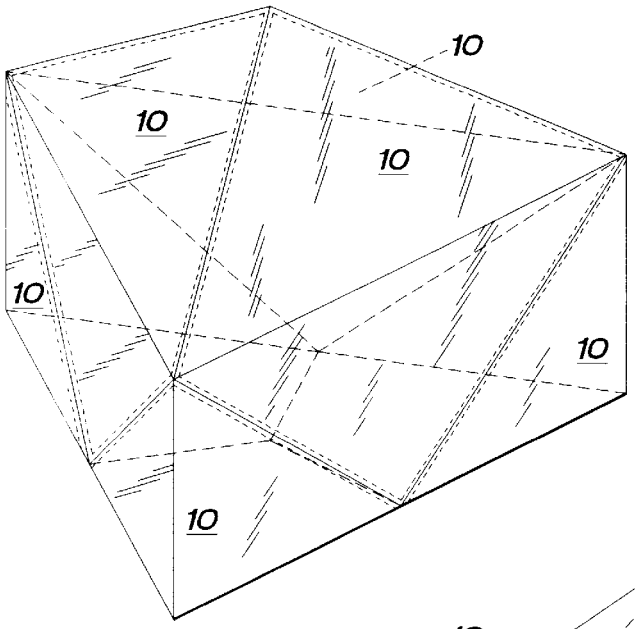
FIG. 34 is a perspective view of a wall tent having the same roof structure as the tent in FIG. 32.
Figure 35:
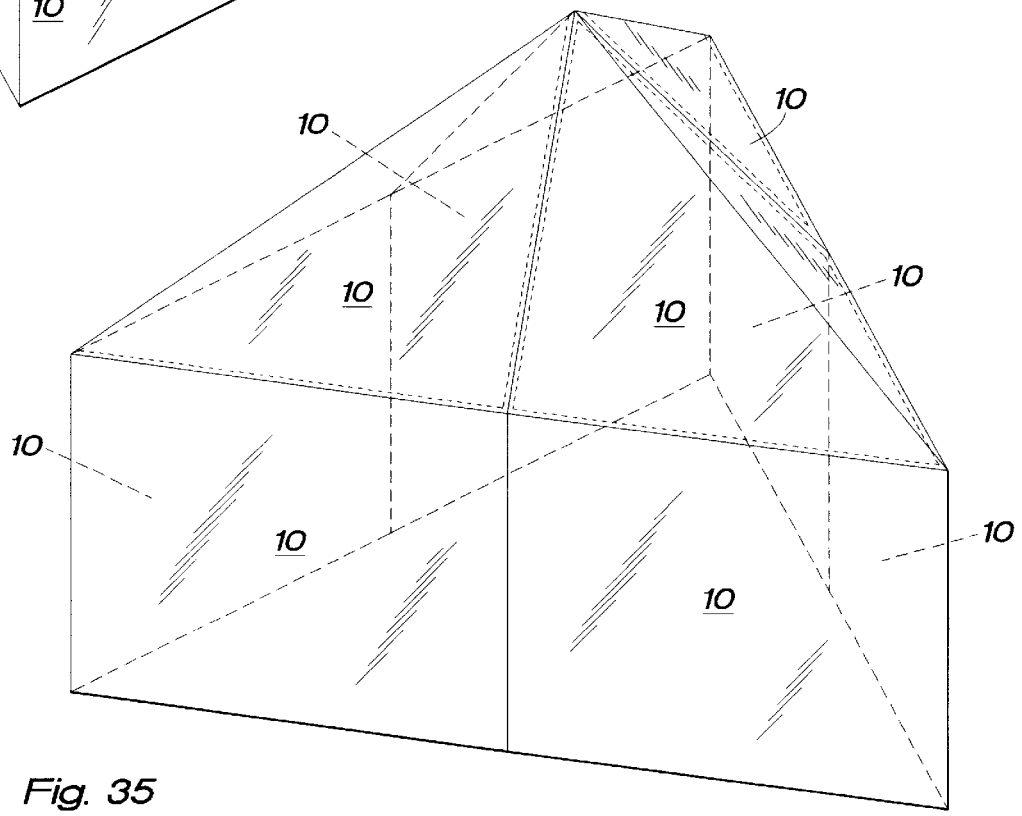
FIG. 35 is a perspective view of a wall tent having the same roof structure as the tent in FIG. 33.

Using the basic canopy form of the tent shown in FIG. 32, another tent, illustrated in FIG. 34, is formed by raising and supporting the roof structure at a height such that the floor panel sections of the three prime panel units 10 of the tent in FIG. 32 form three vertical wall sections that extend downward from the roof structure to engage the ground surface with their lower corners, then coupling three additional primary panel units 10 between each pair of adjacent wall panels to complete the walls as shown. This results in a wall tent with the same basal geometry as the tent shown in FIG. 32 and again having a full floor, but also having far greater headroom. This concept of raising a structural form and adding panel units to form vertical walls below the original structure can be applied to many other tent variations that can be created using the invention. For example, the tent shown in FIG. 33 can be enlarged by raising the structure to a height equal to the length of one side of prime panel unit 10, then coupling six prime panel units 10 to the lower edges of the structure to form a tent, as illustrated in FIG. 35, having greater size, yet having the same geometry as the wall tent illustrated in FIG. 34.

Figure 36:
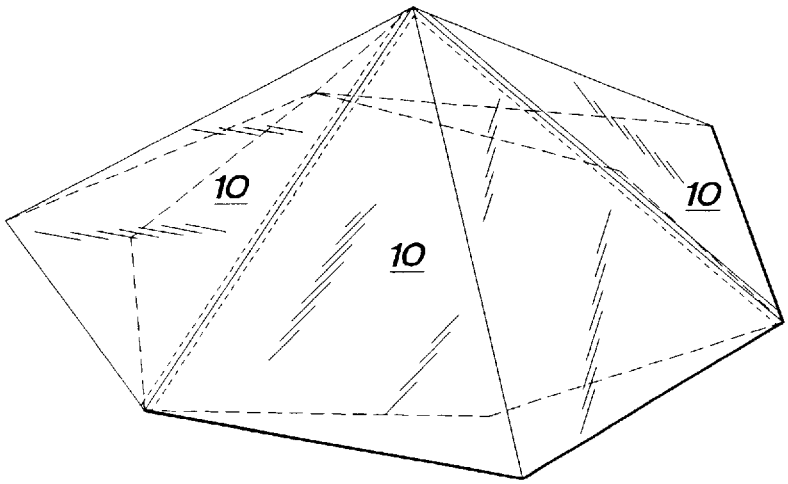
FIG. 36 is a perspective view of a pyramidal tent with a hexagonal base formed from three prime panel units.
Figure 37:
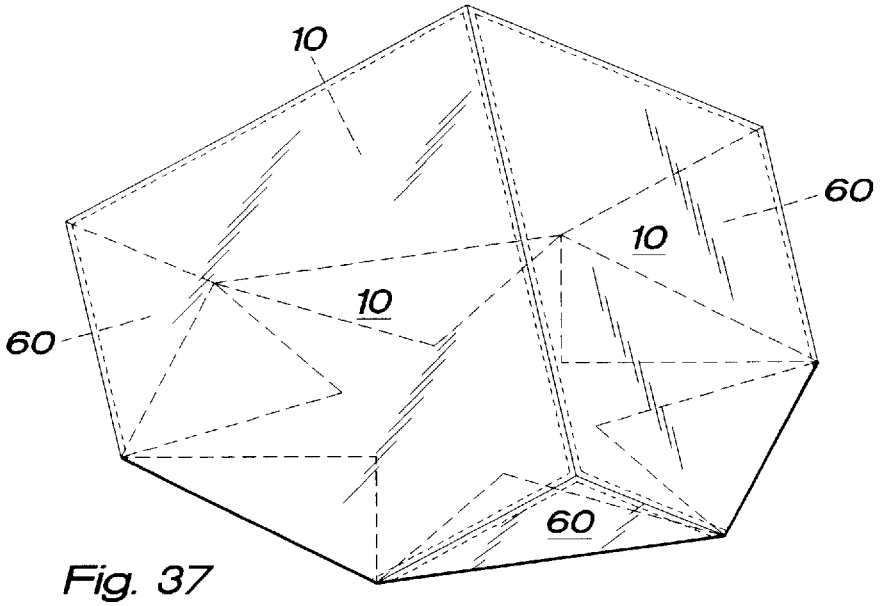
FIG. 37 is a perspective view of a tent having the form of half of a cube, created from three prime panel units and three quarter panel units.

Two additional methods used to increase the height and basal area of a canopy formed from three prime panel units 10 are illustrated in FIGS. 36 and 37. FIG. 36 shows a pyramidal tent with a hexagonal base. The tent is constructed from three primary panel units 10 by widening the opening of each of three ridge end modules and engaging each of the two edges of each of the openings to one edge of each of the other two modules, forming a structure that is intermediate both in basal area and height between the tents shown in FIGS. 32 and 33. In the variation illustrated in FIG. 37 three quarter panel units 60 are engaged with three prime panel units 10 as shown to form a half cube having one corner forming a central peak. An advantage present in this design is that quarter panel units 60 can be made of insect netting and zippers along the edges of quarter panel units 60 can be opened to provide ventilation while the overhanging eaves provide protection from precipitation.

Figure 38:
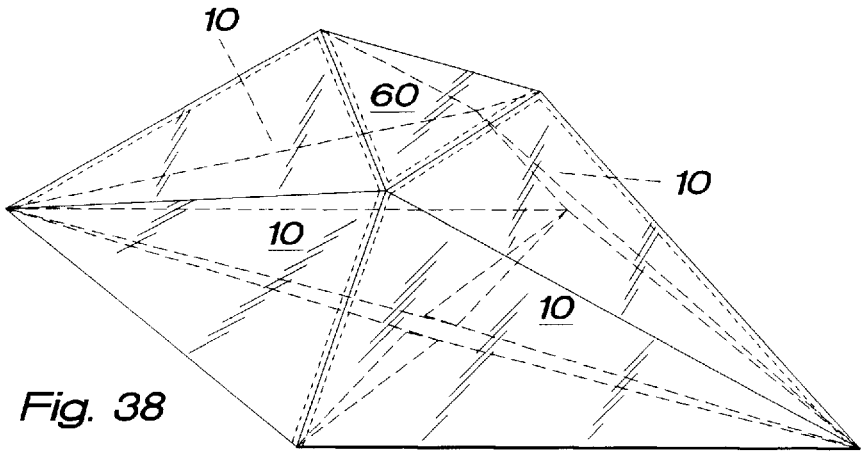
FIG. 38 is a perspective view of a tent formed from four prime panel units and one quarter panel unit.
Figure 39:
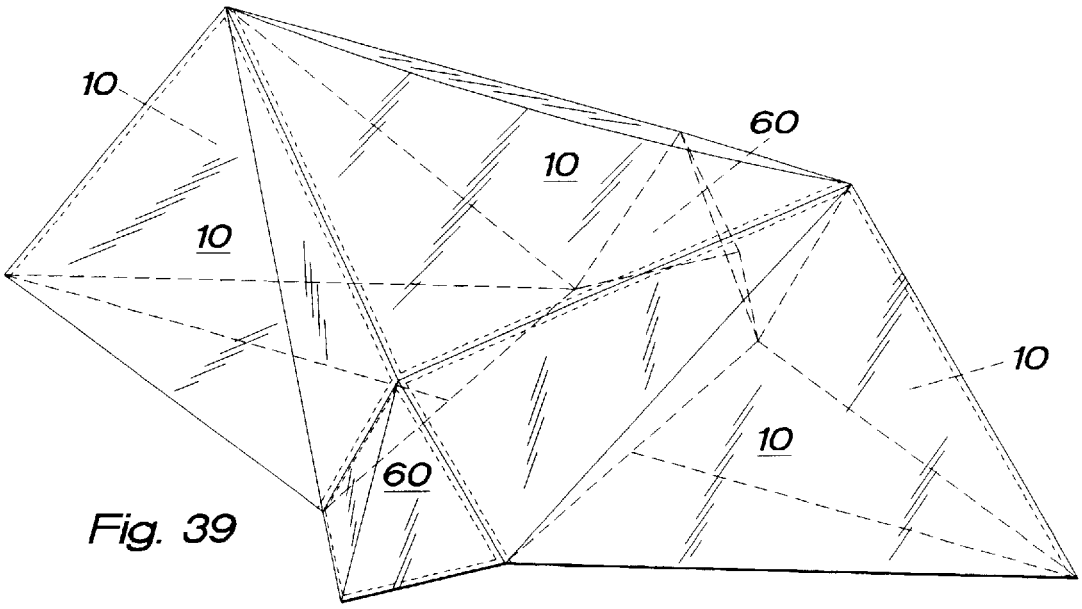
FIG. 39 is a perspective view of a tent formed from five prime panel units and two quarter panel units.

The degree of variability and versatility of tent design possible with this invention is illustrated further in FIGS. 38–39. These illustrations show two examples of complex tent configurations that are clearly not obvious from a cursory consideration of the basic physical design of the invention. A tent which provides improved stability over simpler designs in windy conditions when configured with one end facing into the wind is illustrated in FIG. 38. The tent is constructed from four prime panel units 10 and one quarter panel unit 60. Advantages of another tent, illustrated in FIG. 39, include a large amount of headroom and two areas with floors separated by a floorless central section that can be used for removing clothing in a protected area without getting the covered floor area wet, dirty, or covered with snow.

Figure 40:
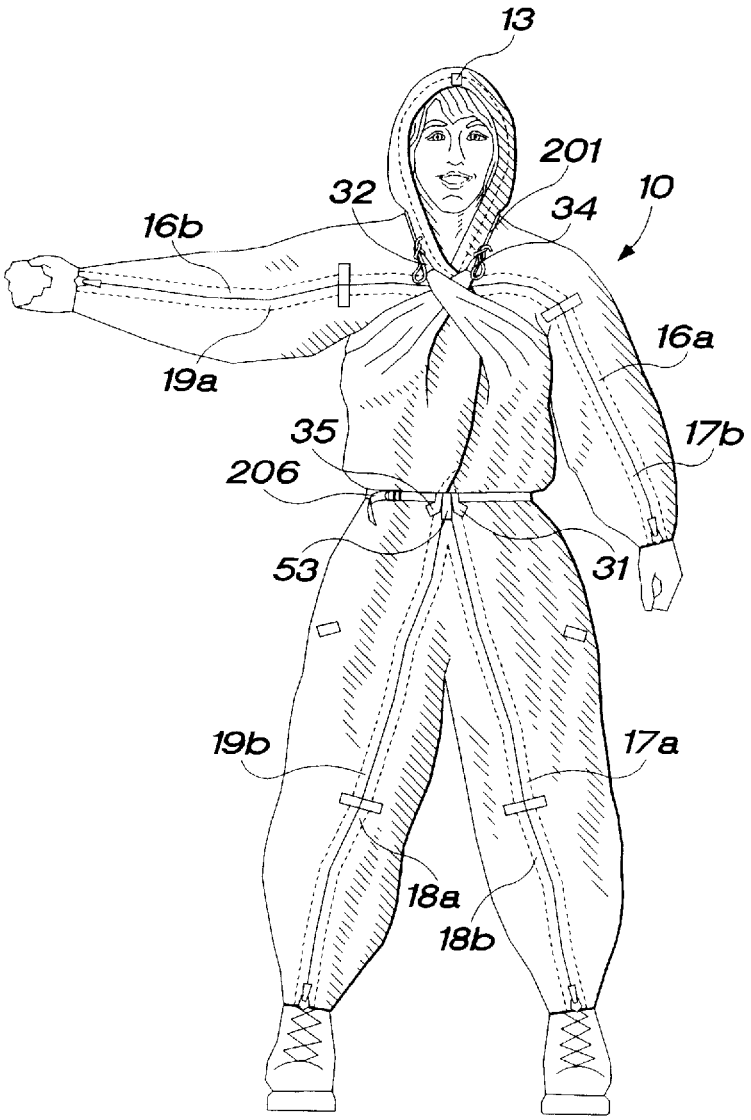
FIG. 40 is a front view of a weatherproof suit.
Figure 41:
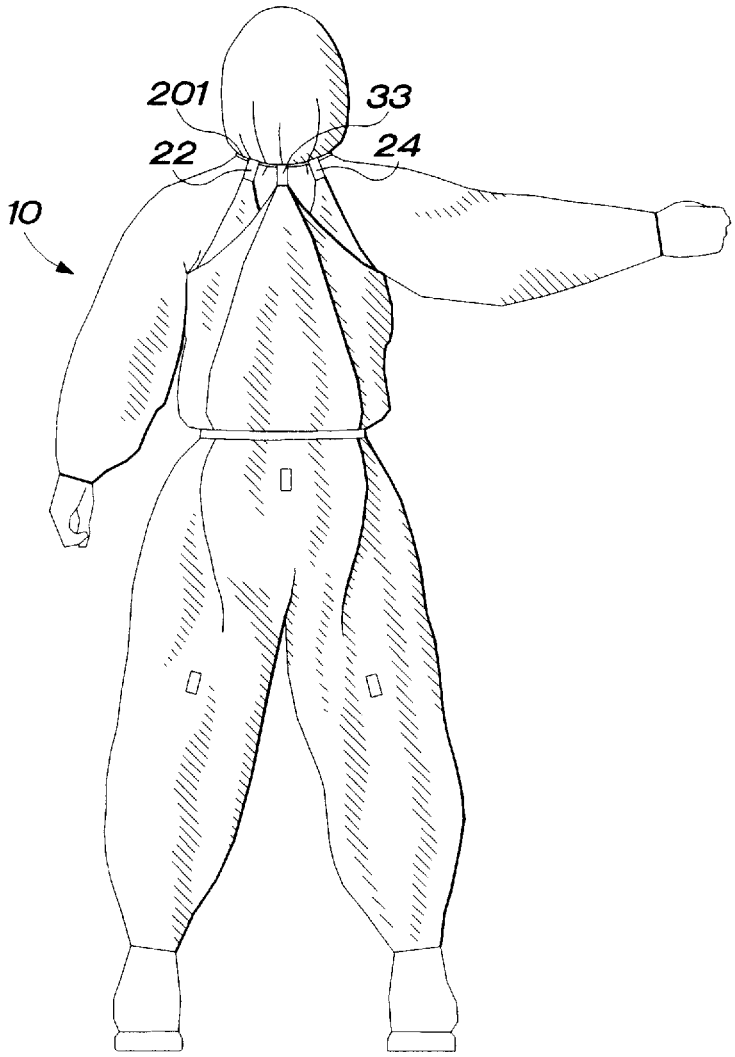
FIG. 41 is a rear view of the weatherproof suit in FIG. 40.
Figure 42:
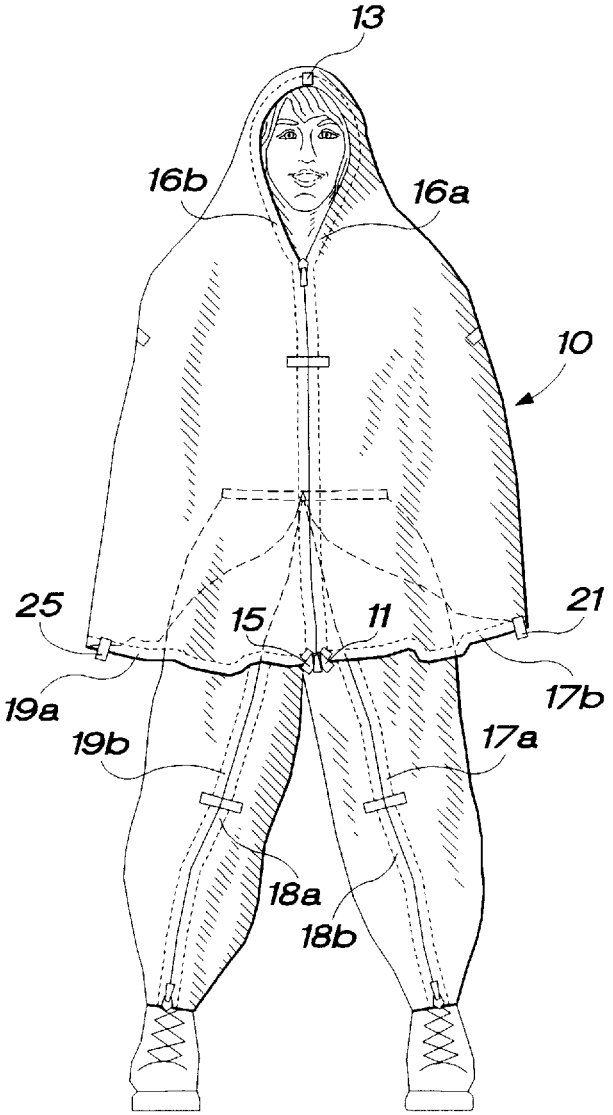
FIG. 42 is a front view of a weatherproof suit having an upper body cape.

Two variations of a weatherproof suit created from a prime panel unit 10 are illustrated in FIGS. 40 through 42. In each of the two variations, the trouser portion of the suit is formed by fastening together zipper tracks 18*a* and 19*b*, as shown in FIGS. 40 and 42, leaving an opening at the tapered end near attachment means 55, shown in FIG. 2, large enough to allow egress of a foot, then repeating the process with zipper tracks 17*a* and 18*b*. With the two trouser legs thus formed in place on the wearer, a waist is formed with a belt, strap, cord, or other suitable fastening device 206 by fastening it through attachment means 31, 53, and 35 and securing it about the outside of prime panel unit 10 and about the waist of the wearer as illustrated in FIG. 40.

Sleeves illustrated in FIGS. 40 and 41 are formed in a similar fashion to the trouser legs. First, zipper tracks 19*a* and 16*b* and zipper tracks 16*a* and 17*b* are fastened together as shown in FIG. 40, leaving an opening at the tapered end of each sleeve large enough to allow egress of an arm. Then each of the sleeve zippers is partially unfastened at the starting end to form an opening large enough to extend from the waist to at least the top of the head. With the sleeves thus formed in place on the wearer, a hood or head opening and a torso portion are then defined with the aid of a cord, strap, or other suitable fastening means 201. To begin, attachment means 13 is drawn up from behind the wearer and positioned at the top of the forehead, creating a large hood over the head and behind the wearer. Fastening means 201 is first attached to attachment means 22, 33, and 24, which are then drawn to a position high on the back of the wearer near the base of the neck, as shown in a rear view of the completed suit illustrated in FIG. 41. The two ends of fastening means 201 are then passed over the shoulders, one at each side of the neck, restricting the hood to a more useful size and form as shown in the front view of the completed suit illustrated in FIG. 40. Attachment means 32 is then pulled upwardly across the chest of the wearer toward the right shoulder and attached to the end of fastening means 201 near the right shoulder. Likewise, attachment means 34 is then pulled upwardly across the chest toward the left shoulder of the wearer and attached to the opposite end of fastening means 201 near the left shoulder. Excess material in the torso area is rolled and tucked beneath the crossed chest panel sections to create a weatherproof seal. In using the suit, excess material at each of the tapered ends of the sleeves and legs of the suit is tucked inside the adjacent opening and held in place by sliding the zipper slider toward the opening to form a snug and comfortable seal about the wrist or ankle. Alternatively, the ends of any of sleeves or legs can be zipped closed to provide additional protection to hands or feet.

The lower half of a weatherproof suit having a cape for the upper portion, as illustrated in FIG. 42, is constructed in the same manner as for the previous suit. The cape portion of the suit is then formed by fastening together zipper tracks 16*a* and 16*b*, then unfastening the end of the zipper near attachment means 13 sufficiently to form a hood-like opening or to allow full egress of the head and neck. The front of the cape is controlled in windy conditions by fastening attachment means 11 and 15, and optionally attachment means 21 and 25, show in FIG. 42, together with the waist band formed by fastening device 206, as previously described and shown in FIG. 40. It can also be completely sealed by fastening together zipper tracks 19*a* and 17*b*.

Figure 43:
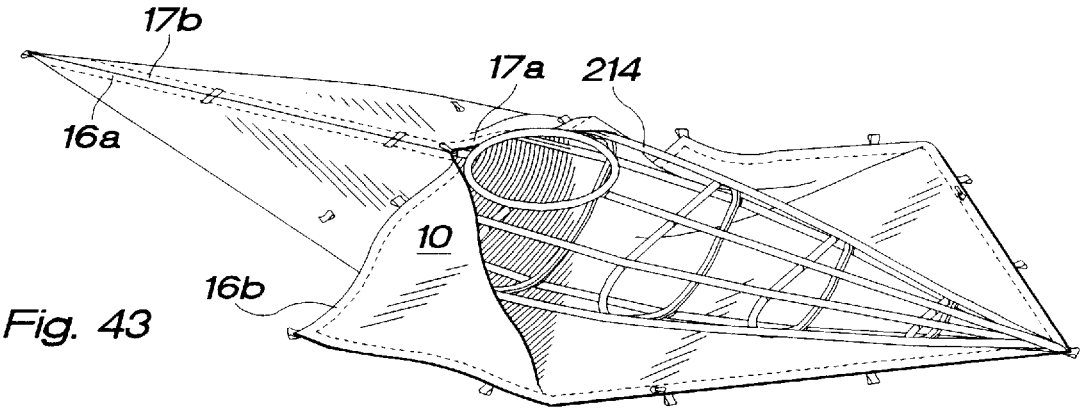
FIG. 43 is a perspective view of a partially assembled kayak.
Figure 44:
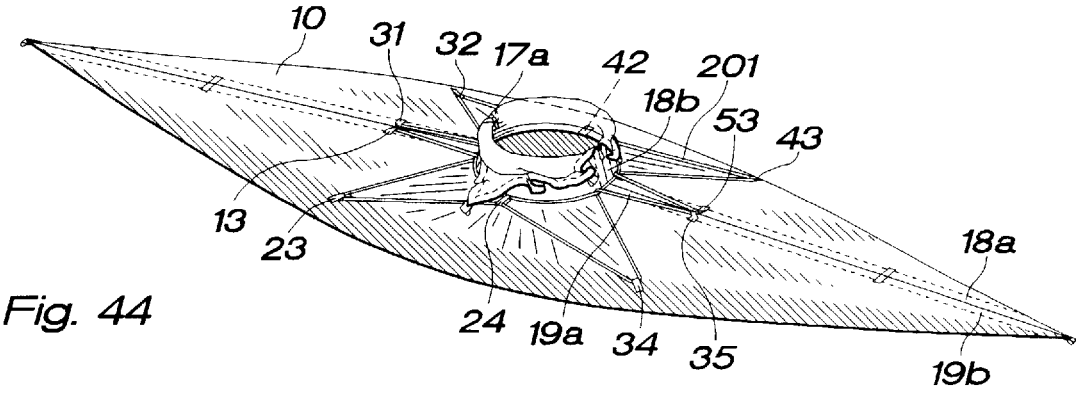
FIG. 44 is a perspective view of a kayak.

A prime panel unit 10 constructed of a waterproof material forms a skin or hull covering for a kayak when stretched over a light framework 214 constructed of a suitable material such as wood, plastic or tubular metal. FIG. 43 shows framework 214 partially covered with prime panel unit 10, assembled by fastening together zipper tracks 16*a* and 17*b* and partially fastening together zipper tracks 17*a* and 16*b*. The framework shown in FIG. 43 is intended for illustration purposes only, and is therefore not claimed as a part of this invention. Starting with the assembly shown in FIG. 43, the completed kayak illustrated in FIG. 44 is created by fastening together zipper tracks 18*a* and 19*b* and partially fastening together zipper tracks 19*a* and 18*b*, then drawing the loose material to the center of the cockpit and fastening a loop of cord or other fastening means 201 around the material and the cockpit rim, then finally lacing the remainder of fastening means 201 between the aforementioned loop of cord and attachment means 13, 31, 32, 42, 43, 53, 35, 34, 24, and 23, stretching the fabric taut over the ends and lower half of the kayak. The additional fabric around the cockpit opening is used as a spray skirt, which is opened and closed as desired with zipper track pairs 17*a* and 16*b*, and 19*a* and 18*b*.

Figure 45:
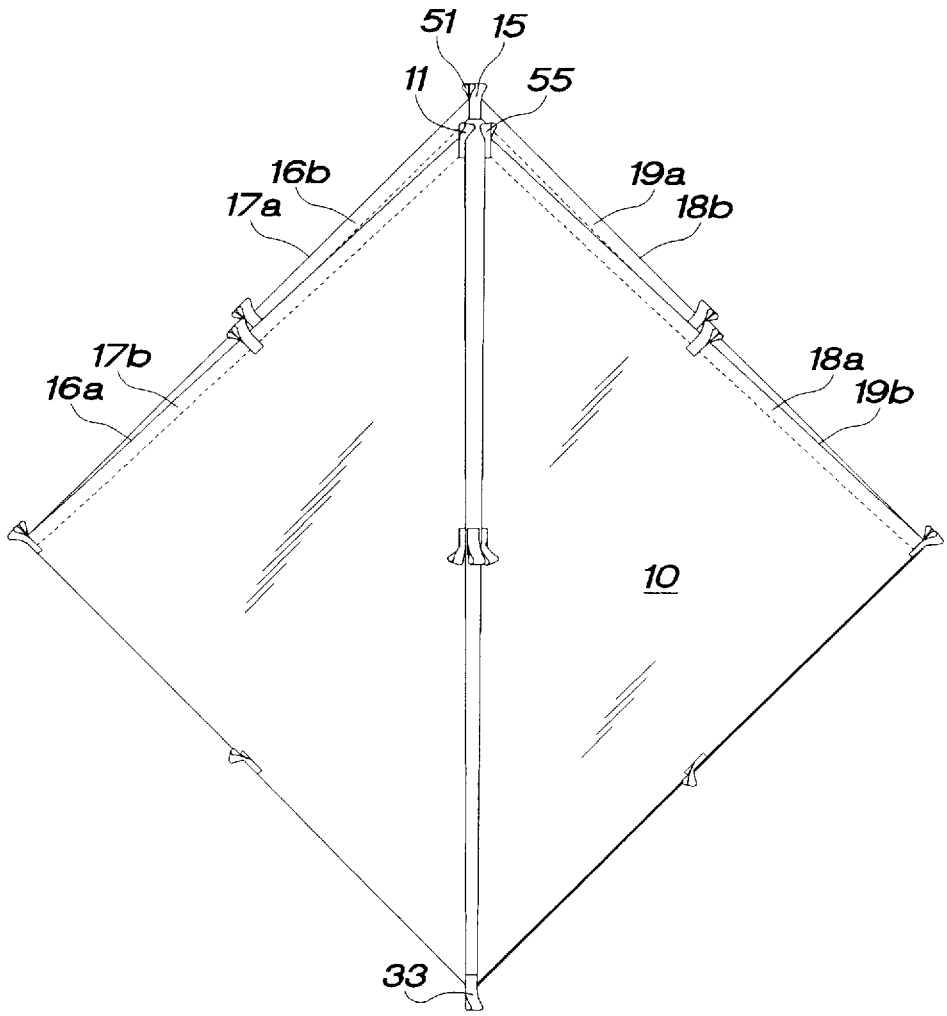
FIG. 45 is a plan view of an initial assembly for forming a backpack from the prime panel unit.
Figure 46:
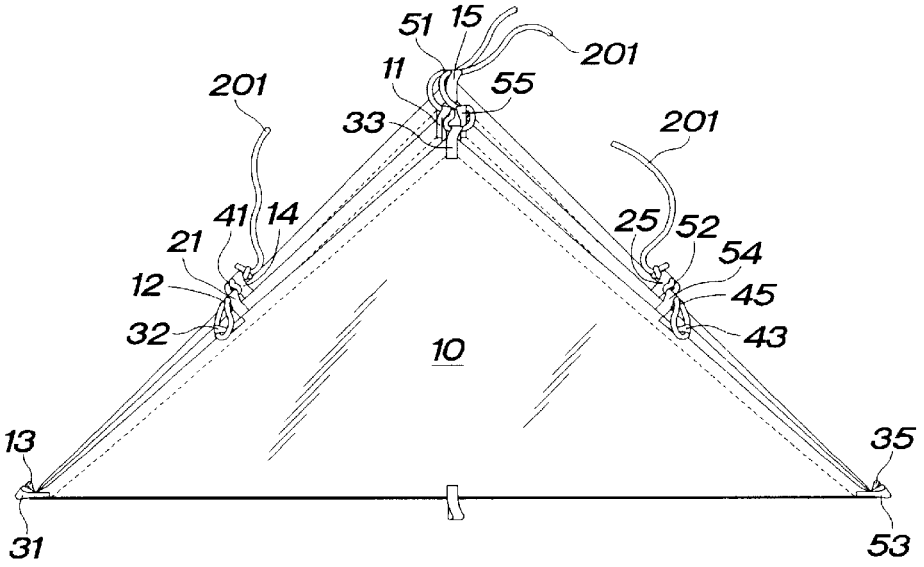
FIG. 46 is a plan view of a partially assembled backpack formed from the prime panel unit.
Figure 47:
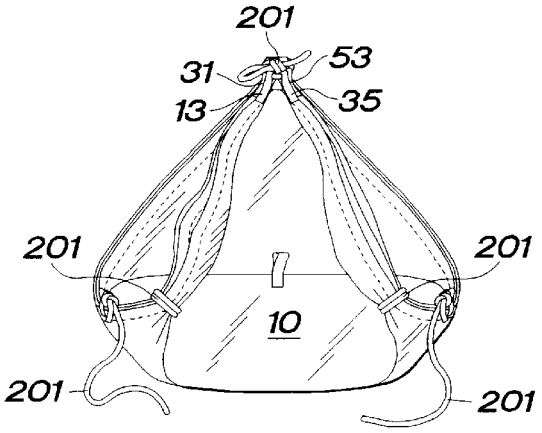
FIG. 47 is a front view of a completed backpack formed from the prime panel unit.

FIG. 47 shows one of several backpack or rucksack variations that is formed from a prime panel unit 10 and six pieces of cord, straps, or other suitable fastening means 201. Beginning with the structure shown in FIG. 45 formed from prime panel unit 10 wherein zipper tracks 16*a* and 17*b*, 17*a* and 16*b*, 18*a* and 19*b*, and 19*a* and 18*b* are fastened together, the initial structure is created by drawing together attachment means 11 and 55 with attachment means 15 and 51, as shown. Attachment means 33 is then drawn together with aforementioned attachment means 11, 55, 15, and 51, using a fastening means 201 to form an intermediate triangular structure from the prime panel unit 10, as illustrated in plan view in FIG. 46. One half of a waistband is formed by fastening together attachment means 32, 12, 21, 41, and 14 with another fastening means 201, leaving a suitable length free to serve as one half of a waistband. Likewise, the other half of the waistband is formed by fastening together attachment means 25, 52, 54, 45, and 43 with yet another fastening means 201, also leaving a suitable length free to serve as a half of a waistband. Fastening means 201, attached to attachment means 33, 11, 51, 15, and 55, is then additionally fastened together with attachment means 31, 13, 53, and 35, to form a pair of pack straps as illustrated in a front view of the completed pack in FIG. 47. The pack shape is defined further by folding the lower edge of the triangular structure of FIG. 46 upward to the position shown in FIG. 47. The pack straps then are defined further by securing the base of each pack strap with fastening means 201 as illustrated in FIG. 47. The resulting backpack comprises three main pockets that are accessed by means of zippers referenced in FIG. 45. Additionally, two pockets on each pack strap are accessed by means of the opposite ends of these same zippers. Soft, resilient materials can be placed in the pockets to pad the pack straps. Pack strap pockets are also particularly useful for carrying small items that may need to be accessed readily, such as communications and signalling devices, navigational equipment, ammunition, or fishing gear.

Figure 48:
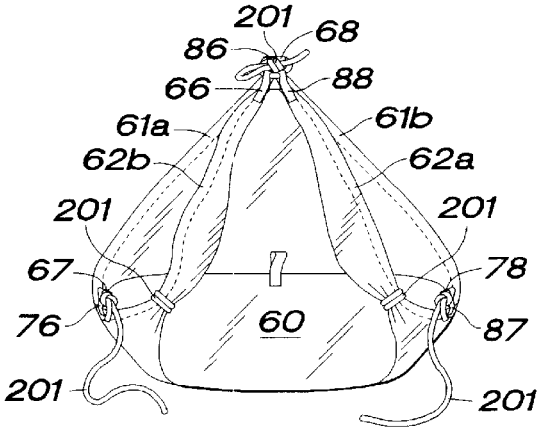
FIG. 48 is a front view of a backpack formed from the quarter panel unit.

A similar backpack illustrated in FIG. 48 is constructed from a quarter panel unit 60 by first fastening together zipper tracks 61*a* and 62*b*, and zipper tracks 62*a* and 61*b* to form a triangular structure of similar general form to the structure shown in FIG. 46. Attachment means 66, 86, 68, and 88 are drawn together and fastened with fastening means 201 to form pack straps. Pack straps then are defined further by securing fastening means 201 around the base of each pack strap as illustrated. One half of the waistband is formed by fastening together attachment means 67 and 76 with fastening means 201 leaving a suitable length free to serve as a half of a waistband. Likewise, the other half of the waistband is formed by fastening together attachment means 78 and 87 with fastening means 201, also leaving a suitable length free to serve as a half of a waistband. The resulting backpack comprises a single main pocket and a pocket on each pack strap, all of which are accessed by means of zippers.

Figure 49:
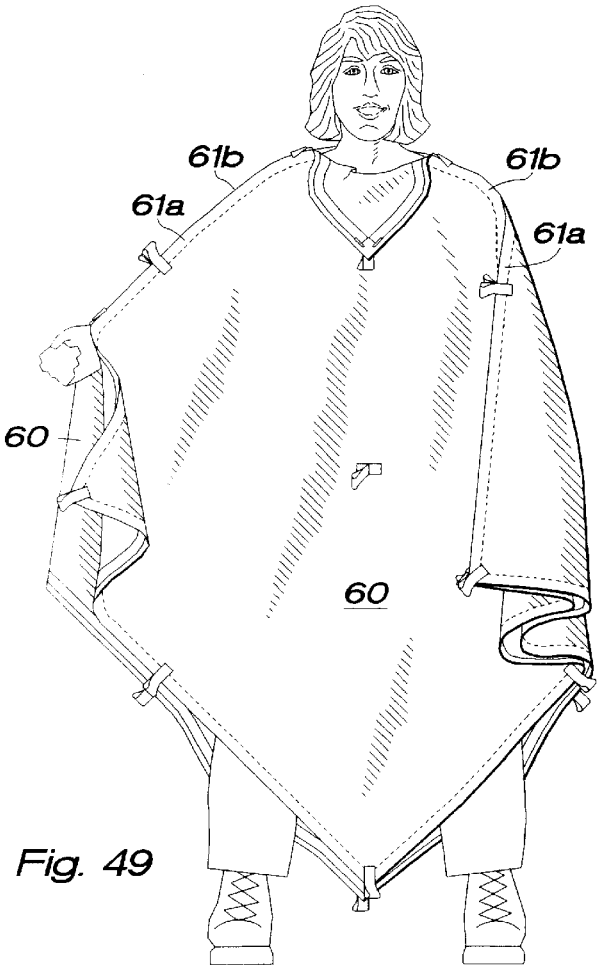
FIG. 49 is a front view of a rain cape formed from two quarter panel units.

In some circumstances, a rain cape may be preferable to a weatherproof suit, particularly in warmer weather. FIG. 49 illustrates a rain cape formed from two quarter panel units 60. The cape is created by fastening together zipper track 61*a* of each of the two units with zipper track 61*b* of the opposite unit. Starting at the intervening corner, both zippers are then unfastened sufficiently to form an opening large enough to allow egress of the head and neck when worn as illustrated.

Figure 50:
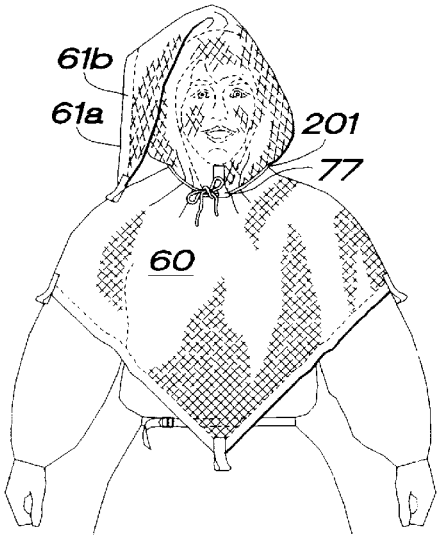
FIG. 50 is a front view of a head net formed from the quarter panel unit having the panel constructed from insect netting material.

A head net, illustrated in FIG. 50, is created from quarter panel unit 60 constructed with a panel made of insect netting by fastening together zipper tracks 61*a* and 61*b* to form a cone. The cone is then placed over the head and upper body such that the previously fastened zipper extends down the back of the wearer and the small end of the cone forms a long, tapered stocking cap. As illustrated, a piece of cord or other fastening means 201 is then fastened loosely around the middle portion of the panel, around the neck, and through attachment means 77 to seal the head net from entry by insects. The lower portion of the quarter panel unit can also be tucked inside a shirt, vest, or jacket to seal it from entry by insects, in place of using fastening means 201.

RAMIFICATIONS AND SCOPE

An additional fastening means such as hook-and-loop fasteners or snaps may be attached to the overlapping portion of the edges, particularly at the corners and at the middle of each edge to seal the juncture more completely.

The panel of either type of unit may be constructed of a variety of thin sheet materials, each of which has specific advantages and disadvantages. Lightweight nylon fabrics with coatings, such as polyurethane, are waterproof and low in weight and bulk but do not breathe. Consequently, they often suffer from ventilation and condensation problems. Fabrics laminated with PTFE, although generally somewhat heavier, bulkier, and more expensive, have the advantage of being both waterproof and breathable, but must be kept clean to function properly. A combination in which one half of the panel is composed of each of these two types of fabric provides a reasonable compromise for many circumstances. Fabric comprised in part of a PTFE film that has been developed to withstand extended immersion, although heavier, may be preferable in situations where use as a kayak is planned, likely, or where such use may be critical for survival. For other uses where weight is not as critical, such as when pack stock, motor vehicles, or other suitable means of transport are available, heavier fabrics may be preferred. While cotton canvas would tend to leak excessively if used to form a kayak, a linen fabric may provide an acceptably watertight skin for some uses. Panels may also be constructed of any number of other diverse types of materials ranging from heavy, coated materials intended specifically for use as tent floors to thin polyester films for extremely lightweight applications.

The addition of a hood to form a poncho, as in previously-referenced prior art, is an obvious modification option. Adding a hood creates several disadvantages, though, including decreasing the tear strength of the panel unit, allowing the portion of the panel surrounding the opening for the hood to distort, increasing the bulk and weight, providing an increased opportunity for leakage, and increasing the cost of manufacture. It might, however, be useful in providing an additional means for ventilating the structure in inclement weather. By orienting the hood to face downward to prevent precipitation from entering, and then propping it open, the hood opening provides unobstructed communication of air between the inside and outside of the shelter.

A half panel unit comprising a rectangular panel with the long sides the same length as the side of a prime panel unit and the adjacent sides half that length is conceivable and foreseen. However, it is less versatile than either of the other panel units due to its lesser degree of symmetry. Nevertheless, it could be used as a poncho by adding a hood near the center of the panel, and further used as a ventilating device, as previously discussed.

A greater number of attachment means than described in the preferred embodiment would increase the versatility of the panel units. However, with current technology, it would also increase the complexity and cost of manufacture as well as increase weight and bulk. It is foreseeable that in the future a means will be developed that will provide a greater number of attachment means without these disadvantages.

It is also foreseeable that a means will be developed in the future that will be superior to the zipper as an engaging means. Desired advantages for such a means applicable to this invention include a waterproof seal, the ability to juxtapose and fasten edges in a greater variety of positions, and an engaging means that does not require the use of two different types of components.

The descriptions above provide illustrations of some of the embodiments of this invention and should not be construed as limiting the scope of the invention. Many other variations in construction and use are possible. Various changes and modifications will occur to those skilled in the art without departing from the true scope of the invention as defined in the claims. It is an intention basic to the nature and spirit of the invention, and therefore within the scope of the invention, that additional uses and applications beyond those illustrated herein will be developed.

I claim:

1. A prime panel unit comprising a prime panel comprised of a substantially square panel of thin sheet material, said prime panel having an upper surface, a lower surface, four corners, a center point located on said prime panel equidistant from all said corners, and four edges, each said edge having a midpoint located midway between said corners terminating each said edge;

a plurality of engaging means disposed along said edges and fastened to said lower surface of said prime panel, each said edge having said engaging means, said engaging means providing a means for continuously connecting each said edge selectively with each said edge of said prime panel of any said prime panel unit; and a plurality of attachment means fastened to said prime panel and disposed at intervals on said upper surface, along each said edge, and at each said corner in a regular and evenly-spaced grid, said attachment means providing a means for attaching various devices to said prime panel, and having, said engaging means, all elements thereof, and all said attachment means disposed in a four-fold radially symmetrical pattern about said center point, whereby said prime panel unit provides a means for forming a multitude of configurations including shelters, bivouac sacks, a weatherproof suit, a kayak hull covering, and a backpack from said prime panel unit, and a multitude of diverse forms of tents from a plurality of said prime panel units fastened together by means of said engaging means.

2. The prime panel unit of claim 1, wherein each said engaging means comprises a first engaging means disposed along one half of each said edge, extending approximately from said midpoint of each said edge to one said corner terminating said edge; and a second engaging means distinct and separate from said first engaging means and providing a means for engaging with said first engaging means, said second engaging means being disposed along each remaining half of each said edge and extending in a direction opposite said first engaging means disposed along same said edge.

3. The prime panel unit of claim 1, wherein each said engaging means comprises a first engaging means comprising a zipper track with sliders, said first engaging means being disposed along one half of each said edge and extending approximately from said midpoint of each said edge to one said corner terminating said edge; and a second engaging means distinct and separate from said first engaging means and comprising said zipper track without said sliders, said second engaging means being disposed along each remaining half of each said edge and extending in a direction opposite said first engaging means disposed along same said edge, and each said second engaging means providing a means for engaging with each said first engaging means.

4. A quarter panel unit comprising a quarter panel comprised of a substantially square panel of thin sheet material, said quarter panel having an upper surface, a lower surface, four corners, a center point equidistant from all said corners, and four edges;

a plurality of engaging means disposed along said edges and fastened said lower surface of to said quarter panel, each said edge having said engaging means, said engaging means providing a means for continuously connecting each said edge selectively with each of at least two said edges of said quarter panel of any said quarter panel unit, and said engaging means and all elements thereof being disposed in a two-fold radially symmetrical pattern about said center point; and a plurality of attachment means fastened to said quarter panel and disposed at intervals on said upper surface, along each said edge, and at each said corner in a regular and evenly-spaced grid having four-fold radial symmetry about said center point, said attachment means providing a means for attaching various devices to said quarter panel, whereby said quarter panel unit provides a means for forming a multitude of configurations including a backpack and a headnet from said quarter panel unit and a multitude of diverse forms of shelters and a rain cape from a plurality of said quarter panel units fastened together by means of said engaging means.

5. The quarter panel unit of claim 4, wherein each said engaging means comprises a first engaging means disposed along each of two opposed and parallel said edges; and a second engaging means distinct and separate from said first engaging means, said second engaging means being disposed along each of two remaining said edges unoccupied by said first engaging means and providing a means for engaging with each said first engaging means.

6. The quarter panel unit of claim 4, wherein each said engaging means comprises a first engaging means disposed along each of two opposed and parallel said edges and comprising a zipper track with sliders, and a second engaging means distinct and separate from said first engaging means and comprising said zipper track without said sliders, said second engaging means being disposed along each of two remaining said edges unoccupied by said first engaging means and providing a means for engaging with each said first engaging means.

7. A shelter system comprising a plurality of panel units selected from the group consisting of prime panel units and quarter panel units, each said prime panel unit having a prime panel and each said quarter panel unit having a quarter panel, and each said prime panel and each said quarter panel comprising a substantially square panel of thin sheet material having an upper surface, a lower surface, four corners, a center point located on said upper surface equidistant from all said corners, and four edges, each said edge of each said quarter panel being one half the length of each said edge of each said prime panel;

a plurality of engaging means disposed along said edges and fastened to said lower surface, each said edge having said engaging means; and a plurality of attachment means fastened to said upper surface and disposed at intervals on said upper surface, along each said edge, and at each said corner in a regular and evenly-spaced grid having four-fold radial symmetry about said center point, said attachment means providing a means for attaching various devices to said upper surface, each said prime panel having a midpoint located midway along each said edge of said prime panel between said corners terminating each said edge of said prime panel, and having said engaging means of said prime panel and all elements thereof disposed in a four-fold radially symmetrical pattern about said center point of said prime panel, said engaging means providing a means for continuously connecting each said edge of each said prime panel selectively with each said edge of said prime panel of any said prime panel unit and with each said edge of said quarter panel of any said quarter panel unit, each said quarter panel having said engaging means of said quarter panel and all said elements thereof disposed in a two-fold radially symmetrical pattern about said center point of said quarter panel, said engaging means providing a means for continuously connecting each said edge of said quarter panel selectively with each said edge of said prime panel of any said prime panel unit and each of at least two said edges of said quarter panel of any said quarter panel unit, and said engaging means providing a means for selectively fastening together and separating said panel units of said shelter system, whereby said shelter system provides a means for forming a multitude of structures of diverse forms, including tents and shelters, from a plurality of said panel units fastened together in diverse combinations by means of said engaging means, and said engaging means provide a means for separating said panel units for ease of handling and transportation and for diverse individual uses.

8. The shelter system of claim 7, wherein each said engaging means comprises a first engaging means, said first engaging means fastened to said prime panel being disposed along one half of each said edge of said prime panel and extending approximately from said midpoint to one said corner terminating said edge of said prime panel, and said first engaging means fastened to said quarter panel being disposed along each of two opposed and parallel said edges of said quarter panel; and a second engaging means distinct and separate from said first engaging means and providing a means for engaging with said first engaging means, said second engaging means fastened to said prime panel being disposed along each remaining half of each said edge of said prime panel and extending in a direction opposite said first engaging means disposed along same said edge of said prime panel, and said second engaging means fastened to said quarter panel being disposed along each of two remaining said edges of said quarter panel unoccupied by said first engaging means.

9. The shelter system of claim 7, wherein each said engaging means comprises a first engaging means comprising a zipper track with sliders, said first engaging means fastened to said prime panel being disposed along one half of each said edge of said prime panel and extending approximately from said midpoint to one said corner terminating said edge of said prime panel, and said first engaging means fastened to said quarter panel being disposed along each of two opposed and parallel said edges of said quarter panel; and a second engaging means distinct and separate from said first engaging means, comprising said zipper track without said sliders, and providing a means for engaging with said first engaging means, said second engaging means fastened to said prime panel being disposed along each remaining half of each said edge of said prime panel and extending in a direction opposite said first engaging means disposed along same said edge of said prime panel, and said second engaging means fastened to said quarter panel being disposed along each of two remaining said edges of said quarter panel unoccupied by said first engaging means.

* * * * *